US008938997B2

(12) United States Patent
Piccoli et al.

(10) Patent No.: US 8,938,997 B2
(45) Date of Patent: Jan. 27, 2015

(54) SECURITY SURROUND DEVICE WITH CORD LOCK

(71) Applicant: Checkpoint Systems, Inc., Thorofare, NJ (US)

(72) Inventors: Anthony F. Piccoli, West Deptford, NJ (US); Wei Wu, Shanghai (CN); Lawrence Appalucci, Villanova, PA (US); Gary T. Mazoki, Sewell, NJ (US); Thomas J. McKeown, Pennsauken, NJ (US); Seth Strauser, Sewell, NJ (US); James Brodzik, Somerdale, NJ (US)

(73) Assignee: Checkpoint Systems, Inc., Thorofare, NJ (US)

( * ) Notice: Subject to any disclaimer, the term of this patent is extended or adjusted under 35 U.S.C. 154(b) by 29 days.

(21) Appl. No.: 13/732,701

(22) Filed: Jan. 2, 2013

(65) Prior Publication Data

US 2013/0174617 A1 Jul. 11, 2013

Related U.S. Application Data

(60) Provisional application No. 61/583,294, filed on Jan. 5, 2012.

(51) Int. Cl.
*E05B 65/00* (2006.01)
*E05B 73/00* (2006.01)

(52) U.S. Cl.
CPC ..... *E05B 73/0017* (2013.01); *E05B 73/0029* (2013.01)
USPC ..... 70/58; 70/14; 70/57; 70/57.1

(58) Field of Classification Search
USPC ..... 70/14, 18, 19, 30, 49, 57, 57.1, 58, 419
See application file for complete search history.

(56) References Cited

U.S. PATENT DOCUMENTS

| | | | | | |
|---|---|---|---|---|---|
| 343,849 | A | * | 6/1886 | Pond | 24/129 R |
| 394,739 | A | | 12/1888 | Toulmin et al. | |
| 437,548 | A | * | 9/1890 | Anderson | 24/127 |
| 886,905 | A | | 5/1908 | Ward | |
| 1,124,130 | A | * | 1/1915 | Grant | 24/18 |
| 1,165,816 | A | * | 12/1915 | Tichenor | 24/18 |
| 2,190,661 | A | * | 2/1940 | Hauer | 70/49 |
| 2,440,012 | A | * | 4/1948 | Haver | 70/18 |
| 3,612,587 | A | | 10/1971 | Rubin | |
| 3,817,064 | A | * | 6/1974 | Sallee | 70/58 |
| 4,528,217 | A | | 7/1985 | Spathis et al. | |
| 4,979,382 | A | * | 12/1990 | Perry | 70/58 |
| 5,517,835 | A | * | 5/1996 | Smith | 70/14 |
| 5,595,073 | A | * | 1/1997 | Sullivan | 70/18 |
| 5,794,464 | A | | 8/1998 | Yeager et al. | |
| 6,092,401 | A | | 7/2000 | Sankey et al. | |
| 6,188,320 | B1 | | 2/2001 | Kolton et al. | |
| 7,129,841 | B2 | | 10/2006 | Feibelman | |
| 7,481,086 | B2 | | 1/2009 | Fawcett et al. | |

(Continued)

*Primary Examiner* — Christopher Boswell
(74) *Attorney, Agent, or Firm* — Richard A. Howe, II

(57) ABSTRACT

A security device and method to surround merchandise for theft deterrence. The security device includes a cord and housing for a knot in the cord. The cord is pulled from one end about the knot to tighten cord around a product and the cord is pulled from another section to lock cord in place around the product. The device serves to deter breaking in or stealing merchandising product. The security device may also include an additional housing for the cord to pass through. Either housing may include an EAS and/or RFID element for additional security.

31 Claims, 22 Drawing Sheets

(56) References Cited

U.S. PATENT DOCUMENTS

| | | | | |
|---|---|---|---|---|
| 7,543,466 | B2 * | 6/2009 | Loughlin et al. | 70/8 |
| 7,784,313 | B2 * | 8/2010 | Wyers | 70/49 |
| D628,924 | S | 12/2010 | Sayegh et al. | |
| 7,918,112 | B2 | 4/2011 | Fawcett et al. | |
| 8,044,806 | B2 * | 10/2011 | Sayegh | 70/57.1 |
| 8,234,757 | B2 * | 8/2012 | Lesley | 70/18 |
| 8,528,372 | B2 * | 9/2013 | Nilsson | 70/57.1 |
| 2008/0236209 | A1 | 10/2008 | Conti et al. | |
| 2010/0139336 | A1 | 6/2010 | Necchi | |
| 2010/0155265 | A1 | 6/2010 | Kidd | |
| 2013/0067967 | A1 * | 3/2013 | Olear et al. | 70/18 |

* cited by examiner

SECURITY SURROUND DEVICE WITH CORD LOCK

CROSS-REFERENCE TO RELATED APPLICATION

This application claims the benefit under 35 U.S.C. §119 (e) of the earlier filing date of U.S. Provisional Application Ser. No. 61/583,294 filed on Jan. 5, 2012, the entire disclosure of which is hereby incorporated by reference herein as if being set forth in its entirety.

BACKGROUND

The present disclosure relates to a security device and method to surround merchandise with a cord having a knot, housed within a lock component. The cord may be lengthened and shortened from about the knot in the lock component so as to appropriately surround the merchandise and then locked from about the knot in the lock component.

Retail stores face the problem of providing potential consumers with opportunity to pick-up and handle various forms of merchandise packaging at a cost that the merchandise packaging may be broken into and the particular merchandise within stolen. Often, retailers display particular merchandise behind glass casing, with access only provided to the consumer after a store employee unlocks the casing and removes the merchandise on behalf of the customer. Other merchandise, particularly high-end merchandise, are often fitted with anti-theft security devices having mechanical and/or electrical lock and cable to wrap merchandise in a closed condition. These wrap locking devices allow for a customer to pick up and inspect the packaging of the merchandise. However, these wrap locking devices often include numerous mechanical components to lock the device on or around the merchandise and necessitate a store employee to eventually unlock and remove the device.

For example, a particular security device, shown in U.S. Pat. No. 5,794,464, includes a locking member, ratchet member, and plurality of cables. The ratchet member includes a gear and bearing to form a reel of which the cables are wound and unwound. The security device is tightened around a package by rotating the gear and bearing with an external tool. The tool operates the latch mechanism, both for tightening the cable about the object to be protected and to release the latch mechanism after the security component has been removed from the package, to enable the internal mechanism on which the cable is wound to be free-wheeling in order to be pulled outwardly to a larger size for placement around another package.

As shown in U.S. Pat. No. 6,092,401, another security device includes a strap, housing with a locking mechanism, cables, and crossover connector. The cables extending through the crossover connector and are affixed to a package as the strap is inserted into the housing, with the cables connected to both the strap and housing. Locking fingers in the housing engage teeth along the strap as the strap is slid in. A key is required to deflect the locking fingers out of locking engagement and away from the teeth of the strap to release the security device from the package.

As shown in U.S. Pat. No. 7,481,086, another security device includes a ratchet mechanism, locking member, and plurality of cables. Cables extend through a fastener and base of the locking member. The fastener is releasably snap-fitted into the base and secured by magnetically attractable tine. The ratchet mechanism includes spool and locking pawl. The housing of the ratchet mechanism includes a rotatable central portion key receiving recess to unlock the spool from the pawl. A rotatable top wall portion of the housing has a flip-up handle to rotate the top wall portion and the internal ratchet to tighten the cable to an article. A key is required to engage with the locking member to place the locking mechanism in a cable loosening direction so as to remove the security device from an article.

Due to the design in these devices, incorporating often numerous components to lock and/or ratchet cable around merchandise, the components themselves are often costly to manufacture. This in turn results in limited purchase orders by a retailer. Thus, the retailer is limited from applying these types of security devices to as many merchandise as they desire. Also due to cost, these devices are recycled. To recycle usage of the devices, the devices often require a key, as exemplified above, possessed by a store employee such as a cashier or manager, to remove the device from merchandise at or before checkout. Store employee interjection to remove the device from merchandise often slows down the checkout process. Due to the limited supply of these devices in a store because of cost and to prevent an elongated checkout for a customer, the devices are typically only placed on few high-end merchandise.

What is needed is a device and method to surround merchandise that can protect a product for one time use, which is disposable and does not require retailer intervention to remove the device. The disposable security device would be more cost effective to manufacture and may be applied to a larger number of store items. A disposable security device that can be thrown out by the consumer at home would decrease the waiting time for consumers at check-out.

SUMMARY

Embodiments of this disclosure provide a security device and method to surround merchandise with cord having a knot, enclosed by a housing, which may be adjusted about the knot to in the merchandise and then locked with the not to hold the cord around, the product.

Embodiments of this disclosure are directed to a security device for a product including a lock housing and a cord. The cord includes a knot configured to allow the length of the cord to constrict about the product and to allow the cord to be locked at the constricted length about the product. The knot is positioned within the lock housing. The lock housing, and part of the cord, located external of the lock, housing, surrounds at least a portion of the product.

According to one embodiment, the cord further includes a head end secured about the lock housing. The cord also includes a tail end opposite the head end on the cord. The cord also includes a knot adjacent cord portion located approximate to the knot on the opposite side of the knot from the tail end. The part of the cord, located external of the lock housing, is between the head end and the knot adjacent cord portion.

According to another embodiment, the lock, housing includes a first support post positioned within the lock housing. The lock housing also includes a second support post positioned within the lock housing. The lock housing also includes a first outlet located about a periphery of the lock housing. The lock housing also includes a second outlet located about a periphery of the lock housing in proximity to the first outlet.

According to one aspect of one embodiment, the first support post is positioned approximately between the second support post, the first outlet, and the second outlet.

According to another aspect of one embodiment, the knot adjacent cord portion is located through the first outlet and the tail end is located through the second outlet.

According to another embodiment, the knot includes a first mop positioned around the first support post and a second loop positioned around the second support post and through the first loop. The cord length constricts between the head end and the knot adjacent cord portion when the tail end is pulled away externally from the second outlet of the housing to move the cord around the first support post in the first loop and around the second support post in the second loop. The first loop constricts around the second loop and the tail end at the first support post to restrict movement of the cord around the first loop and the second loop when the knot adjacent cord portion is pulled away externally from the first outlet of the housing to lock the constricted length of the cord about the product.

According to another embodiment, the security device includes one or more crossover housings. The one or more crossover housings include at least one guide channel positioned inside the crossover housing. The one or more crossover housings also include at least one pair of crossover openings. Each crossover opening of the pair of crossover openings is located about the periphery of the crossover housing. The crossover guide channel runs between each crossover opening. A section of the cord, external of the lock housing, is positioned in the crossover guide channel and through the pair of crossover openings.

According to one aspect of one embodiment, at least one side of the crossover housing comprises an adhesive to fasten the crossover housing to the product.

According to another embodiment, the crossover housing also includes at least one crossover housing support wall, positioned within the crossover housing, to counter an external force on the crossover housing.

According to another embodiment, the crossover housing also includes a security element positioned within the crossover housing. The security element is selected from one of an EAS element or an RFID element.

According to one aspect of one embodiment, at least one side of the lock ho sing includes an adhesive to fasten the lock housing to the product.

According to another embodiment, the lock housing also includes at least one lock housing support wall, positioned within the lock housing, to counter external three on the lock housing.

According to another embodiment, the lock housing includes a lock housing guide channel positioned inside the lock housing and a pair of lock housing openings. Each lock housing opening of the pair of lock housing openings is located about the periphery of the lock housing. The lock housing guide channel runs between each lock housing opening. A section of the cord, between the knot adjacent cord portion and head end, is positioned in the lock housing guide channel and through the pair of lock housing openings.

According to another embodiment, the lock housing comprises a blade, attached in proximity to the second outlet, to cut away the tail end of the cord.

According to one aspect of one embodiment, material of the cord is selected from at least one of metal, plastic, cloth, rubber, wool, or silk.

According to another embodiment, the lock housing further comprises a security element positioned within the lock housing and wherein the security element is selected from one of an EAS element or an REID element.

Embodiments of this disclosure are directed to a method for securing a product. The method includes surrounding a portion of the product with a cord. The method also includes tightening to constrict the length of the cord around the product from a knot in the cord. The knot is located within a lock housing. The method also includes locking the length of the cord in place around the product from the knot in the cord.

According to one embodiment, tightening to constrict the length of the cord includes pulling a tail end of the cord away externally from a second outlet of the lock housing and from the knot to constrict the length of the cord between a head end of the cord and a knot adjacent cord portion of the cord, located through a first outlet. The first outlet and second outlet are located about a periphery of the lock housing. The head end is positioned in the housing. The knot adjacent cord portion is located approximate to the knot on the opposite side of the knot from the tail end.

According to one aspect of one embodiment, locking the length of the cord includes pulling the knot adjacent cord portion away externally from the first outlet to constrict a first loop of the knot around a second loop of the knot and the tail end at a first support post in the lock housing. The lock housing includes a base haying the first support post and a second support post positioned within and a cover. The first support post is positioned approximately between the second support post, the first outlet, and the second outlet.

According to another embodiment, the method also includes forming the knot in the cord and positioning the knot into the base of the lock housing, prior to tightening to constrict the length of the cord.

According to one aspect of one embodiment, forming the knot includes forming the first loop in the knot with the tail end of the cord and the cord. Forming the knot also includes forming the second loop in the knot with the tail end between the tail end and the first loop. Forming the knot also includes passing the tail end about the second loop through the formed first loop.

According to another aspect of one embodiment, positioning, the knot into the base of the lock housing includes positioning the formed first loop around the first support post in the base. Positioning the knot also includes positioning the formed second loop around the second support post in the base. Positioning the knot also includes positioning the knot adjacent cord portion of the cord into the first outlet. Positioning the knot also includes positioning the tail end of the cord into the second outlet. According to another aspect of one embodiment, the method includes placing the bead end of the cord into the base portion.

According to another embodiment, the method includes attaching the cover to the base prior to surrounding the portion of the product.

According to another embodiment, positioning a security element into the lock housing prior to attaching the cover to the base, wherein the security element is selected from one of an EAS element or an RFID element.

According to another embodiment, the method also includes positioning a section of the cord, external of the lock housing, in one or more crossover guide channels and through one or more pair of crossover openings. The one or more crossover guide channels are located inside one or more crossover bases and the one or more pair of crossover openings are located about the periphery of the crossover base. The crossover guide channel runs between each crossover opening in the pair of crossover openings. The method also includes attaching a crossover cover to the crossover base to form a crossover housing, to enclose the section of cord.

According to another embodiment, the method includes fastening the one or more crossover housings to the product with adhesive.

According to another embodiment, the method includes positioning a security element into the crossover housing prior to attaching the crossover cover to the crossover base, wherein the security element is selected from one of an EAS element or an RFID element.

According to another embodiment, the method includes fastening the lock housing to the product with adhesive.

According to another embodiment, the method includes positioning to section of the cord, between the knot adjacent cord portion and the head end, into a lock housing guide channel and through a pair of lock housing openings prior to tightening the cord around the product. The lock housing guide channel is located inside the base and the lock housing openings are located about the periphery of the base. The lock housing guide channel runs between each lock, housing opening in the pair of lock housing openings.

According to another embodiment, the method includes cutting the tail end of the cord by a blade attached in proximity to the second outlet of the lock housing after tightening the cord around the product.

According to one aspect of one embodiment, cutting the tail end of the cord includes forcing the cover down onto the base about the second outlet to move the blade through the cord.

According to another aspect of one embodiment, the method also includes welding the attached cover to the base about a seam about a periphery of the lock housing.

Additional features and advantages of this disclosure will be made apparent from the following detailed description of illustrative embodiments that proceeds with reference to the accompanying drawings.

BRIEF DESCRIPTION OF THE DRAWINGS

The foregoing and other aspects of this disclosure are best understood from the following detailed description when read in connection with the accompanying drawings. For the purpose of illustrating this disclosure, there is shown in the drawings embodiments that are presently preferred, it being understood, however, that this disclosure is not limited to the specific instrumentalities disclosed. Included in the drawings are the following Figures.

DETAILED DESCRIPTION OF ILLUSTRATIVE EMBODIMENTS

This document describes a device and method to surround and secure merchandise for theft deterrence and/or detection using a cord with at least one housing unit, which may surround and lock the surround security device to the merchandise.

Figure 1:
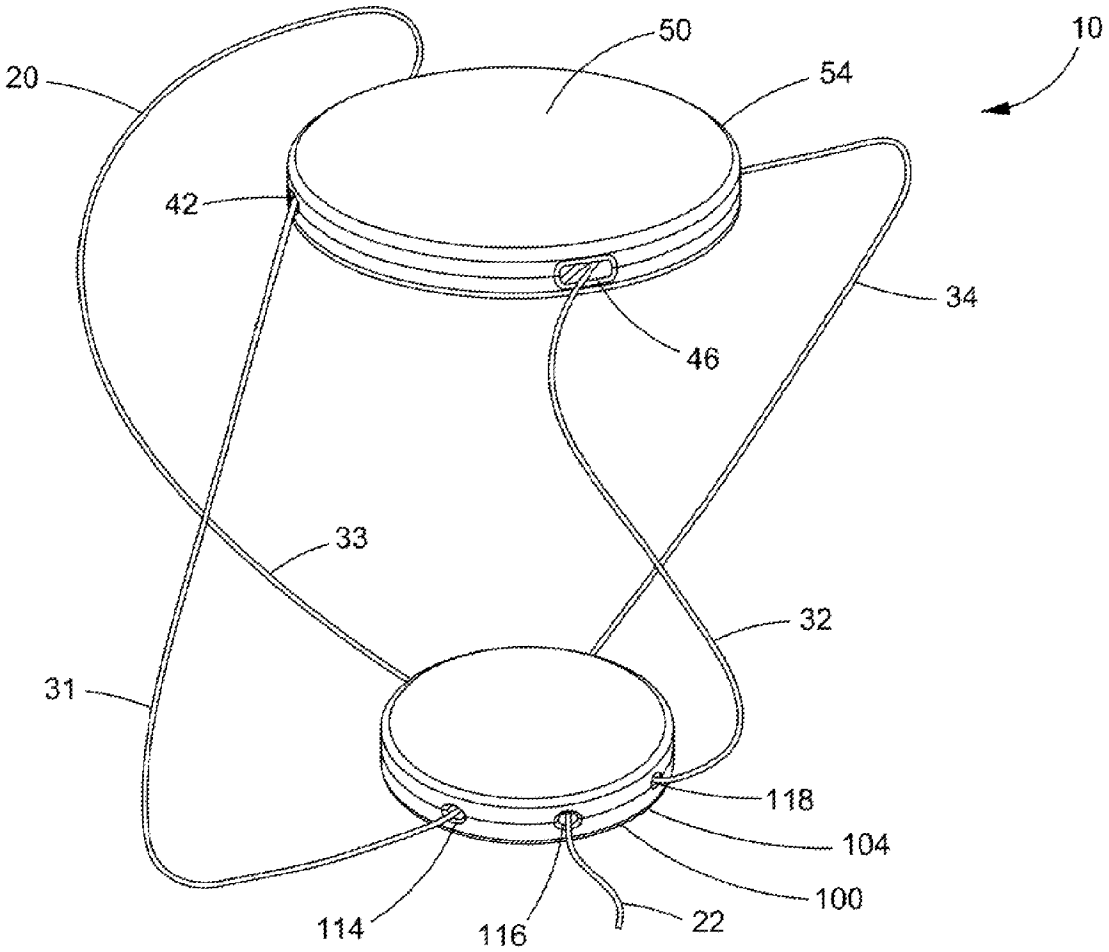
FIG. 1 illustrates a surround security device which includes crossover component, lock component, and cord according to one embodiment.

FIG. 1 illustrates a surround security device 10 which includes crossover component 50, lock component 100, and cord 20. Crossover component housing 54 is the external surface encasement of crossover component 50. Lock component housing 104 is the external surface encasement of lock component 100. As shown in FIG. 1, both the crossover component housing 54 and lock component housing 104 are spherical shaped, like a disk. Also as shown in FIG. 1, the edge about the periphery of each housing, or periphery wall, includes openings.

A single cord 20 extends through and between both the crossover component 50 and lock component 100. As shown in FIG. 1, particular sections of cord 20 are exposed outside of both the crossover component 50 and lock component 100, shown extending between the crossover component 50 and lock component 100. A first cord section 31 is shown extending from first crossover cord guide channel opening 42, located about the periphery wall of the crossover component housing 54, to the cord access way 114, located about the periphery wall of the lock component housing 104. Second chord section 32 is shown extending from fourth crossover cord guide channel opening 46, located about the periphery wall of the crossover component housing 54, to the portal 118 located about periphery wall of the lock component housing 104. A third cord section 33 is shown extending from second crossover cord guide channel opening 44 (see FIG. 17), located about the periphery wall of the crossover component housing 54, to the first cord guide channel opening 110 (see FIG. 17), located about the periphery wall of the lock component housing 104. A fourth cord section 34 is shown extending from third crossover cord guide channel opening 48 (see FIG. 171, located about the periphery wall of the crossover component housing 54, to the second cord guide channel opening 112 (see FIG. 17), located about the periphery wall of the lock component housing 104. A cord tail 22, which is one end of cord 2(, is also shown external of the lock component housing 104 as extending from outside cord tail access way 116, located about the periphery wall, of the lock component housing 104. Location of cord 20 within both the crossover component housing 54 and lock component housing 104 is further described below.

Figure 2:
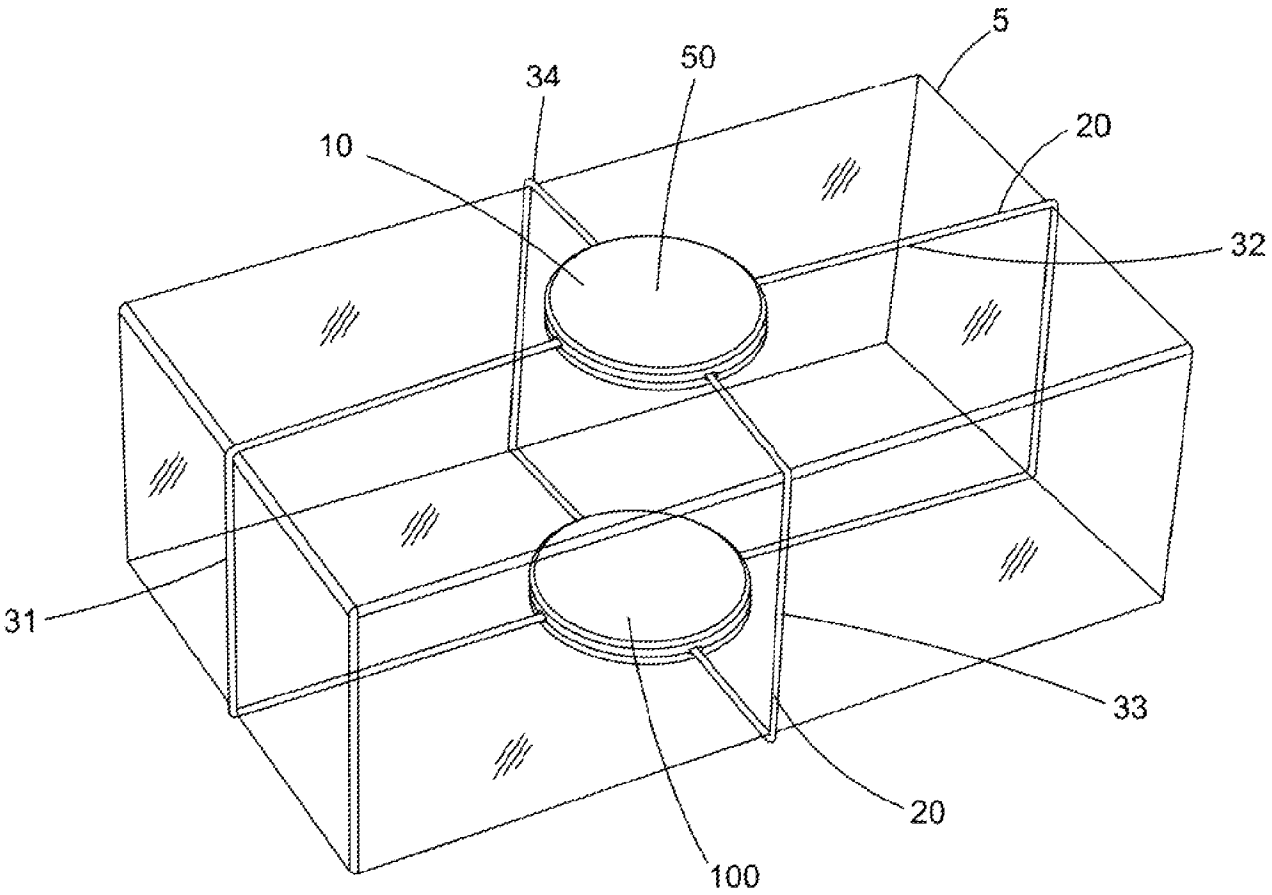
FIG. 2 illustrates a perspective view of the surround security device attached to an exemplary merchandising product according to one embodiment.

FIG. 2 illustrates a perspective view of the surround security device 10, shown in FIG. 1, attached to an exemplary merchandising product 5. The crossover component 50 is shown located on the topside of the rectangular shaped product 5, nearer to foreground in FIG. 2. The product 5 is shown as transparent so as to show the surround security device 10 fitted around the product 5. The lock component 100 is shown on the opposing side of the product 5, visible on the bottom side, in the background. As shown, the surround security device 10 securely surrounds the product 5 about all six sides of the product 5. The surround security device 10 is shown in a locked configuration, such that the cord 20 has been locked within the lock component 100 such that a sufficient tension exists on the cord 20 about the product 5 so that cord 20 may not be simply slipped off or torn off by a potential thief. First cord section 31 and second cord section 32 are shown as approximately equal in length, each stretched from the crossover component 50 to the lock component 100. Third cord section 33 and fourth cord section 34 are shown as equal in length. Depending on the position of either the crossover component 541 and/or lock component 100, the length of either section may differ from the length of another section.

Product 5, shown in FIG. 2, is rectangular in shape. However, products come in variable sizes and shapes. The surround security device 10 can be configured to a fit around products of variable sizes and shapes. Cord 20 may be of various lengths and widths. Cord 20 may be of length and width to extend around and ultimately secure larger merchandise products such as trash cans, cooking grills, and boxed shelving. Cord 20 may be smaller in length and smaller in width so as to secure around smaller products such as battery packs or cold medication. The cord 20 can conform to wrap around various product shapes, as for example but not limited to cylinder shaped products, such as baby formula containers; spherical shaped products, such as howling balls; and any other diversely shaped product. Products having various shapes and contortions may require that any one or more cord sections be different in length than other cord sections for proper fitting around the product to sufficiently tighten around the product of a particular shape.

The crossover component 50 and locking component 100 shown in FIG. 1 are spherical. As shown in FIG. 1, the diameter of the crossover component housing 54 is approximately 45 mm and the height is approximately 6 mm. The diameter of the lock component housing 104 is 31 mm and the height is 6 mm. In other embodiments, the crossover component 50 and/or locking component 100 may be of various shapes and sizes to optimize security of a particular product. In other embodiments, the diameter or height of the crossover component 50 and lock component 100 may be the same or different. The crossover component housing 54 and/or lock component housing 104 may have a larger diameter to fit on a larger product or to provide more visibility to customers that the surround security device 10 is affixed to a particular product. Smaller diameter housing may be constructed to properly fit on smaller products, so as not to block out portions of product packaging, or to lessen visibility to customers that a particular product has a security component attached. In other embodiments, the crossover component housing 54 may be of similar or different shape than the lock component housing 100 shape. For example, the shape of either or both housings may be, but not limited to, a cylindrical, rectangular, square, or triangular shape. In other embodiments, the housings may be designed to a particular shape so as to properly fit on or about a particular product. In other embodiments, either or both housings or portions of the housings may be transparent or opaque. For example, a transparent housing may be used to show potential consumers that an EAS element is located within (see FIGS. 17, 18, and 19).

Figure 3:
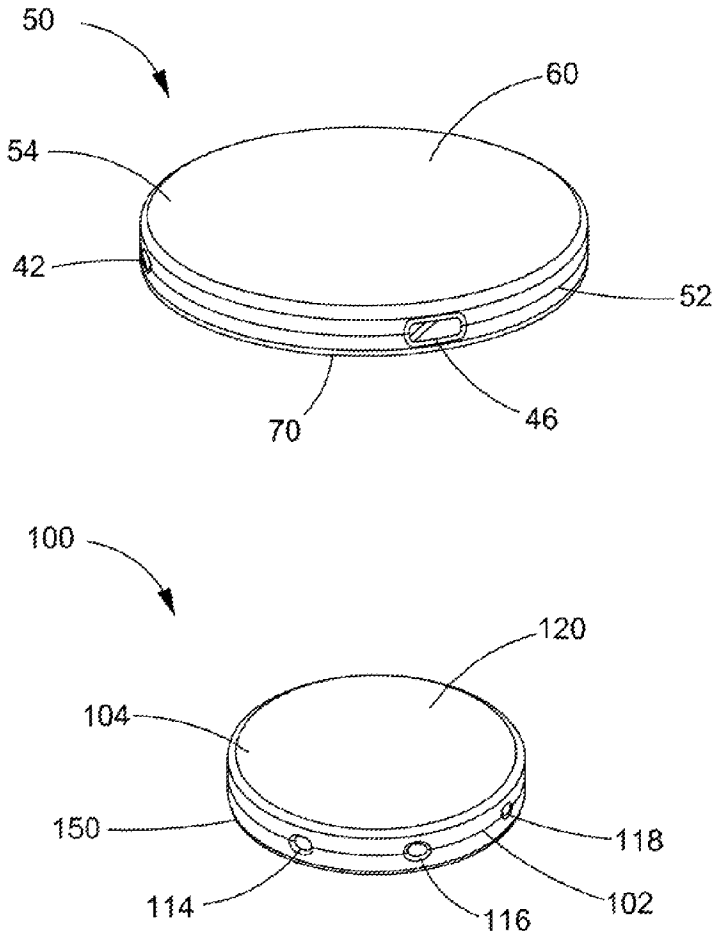
FIG. 3 illustrates the crossover component and lock component of the surround security device of FIG. 1 without the cord.

FIG. 3 illustrates the crossover component 50 and lock component 100 of the surround security device 10 of FIG. 1 without showing cord 20. The crossover component housing 54 includes two pieces, a crossover component cover 60 and crossover component base 70 connected to each other at the crossover component housing seam 52 around the periphery wall of the crossover component housing 54. The lock component housing 104 includes two pieces, a lock component cover 120 and lock component base 150 connected to each other at the lock, component housing seam 102 around the periphery wall of the lock component housing 104. The two pieces of the crossover component 50 and lock component 100 may be tightened or pressed together for connection. Preferably, the two pieces may also be ultra-sonic weld together. Alternatively, adhesive may be applied to portions of either or both bases or covers to keep the pieces together.

As further shown in FIG. 4A through 11, the two pieces of the lock component housing 104 and crossover component housing 54 are solid structures formed from mold. In the preferred embodiment, the pieces do not include mechanically connected components. The pieces may be formed from numerous materials, including but not limited to plastics; wood, carbon fiber rubber, and/or metal. In other embodiments, a housing may be formed with flexible rubber such that the housing can bend to better fit on a product, as for example on a round product. Some pieces may be formed with the same material; where as other pieces may be formed with different material. For example, the lock component base 150 may be formed with plastic and the lock component cover 120 may be formed with metal. In other embodiments, parts within either base or cover can be thrilled from material different than material used with other parts in the same base or cover. In the preferred embodiment, both pieces of the lock component housing 104 and crossover component housing 54 are formed with plastic.

Figure 4A:
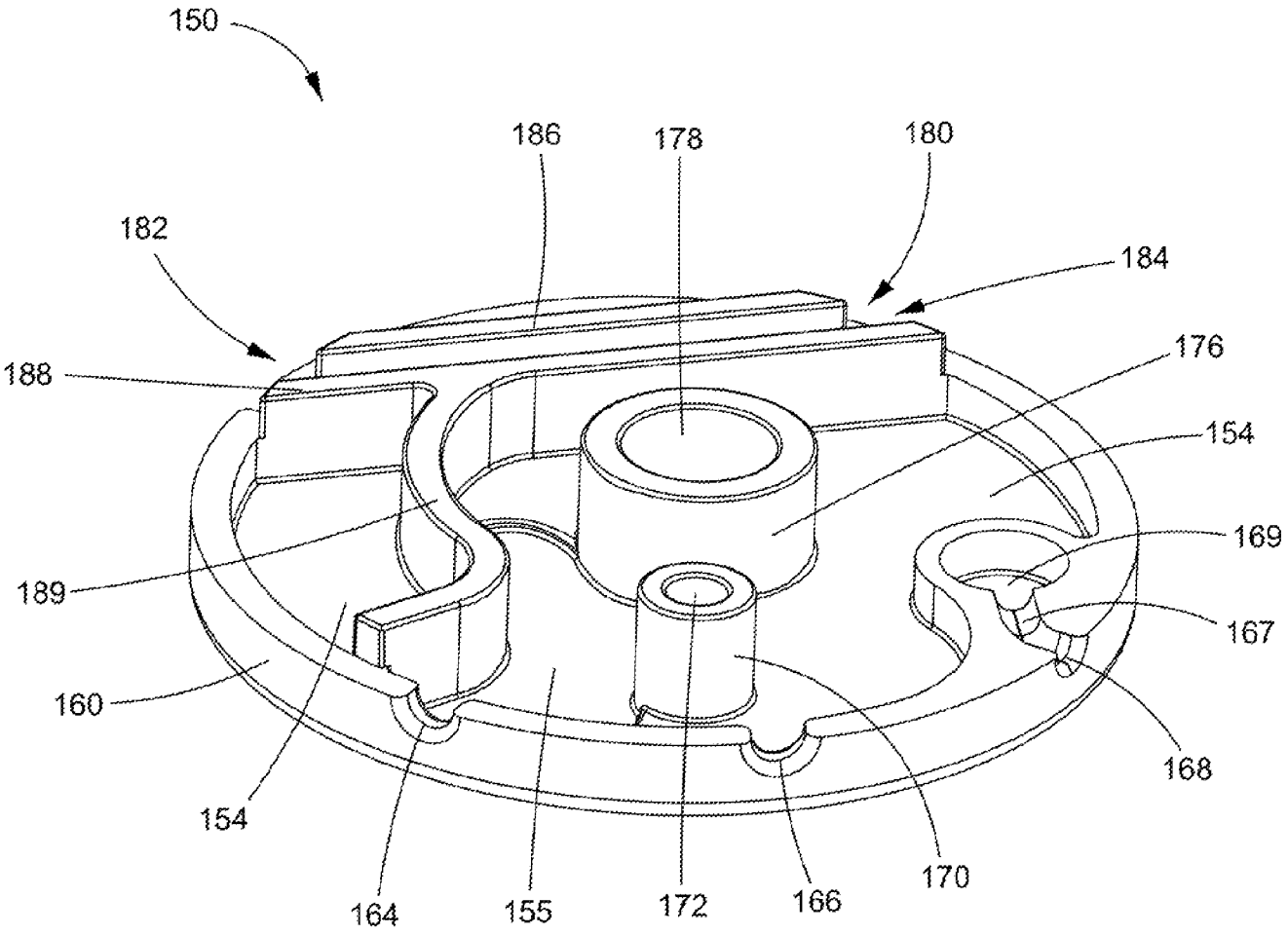
FIG. 4A illustrates a perspective view of the lock, component base of lock component according to one embodiment.
Figure 4B:
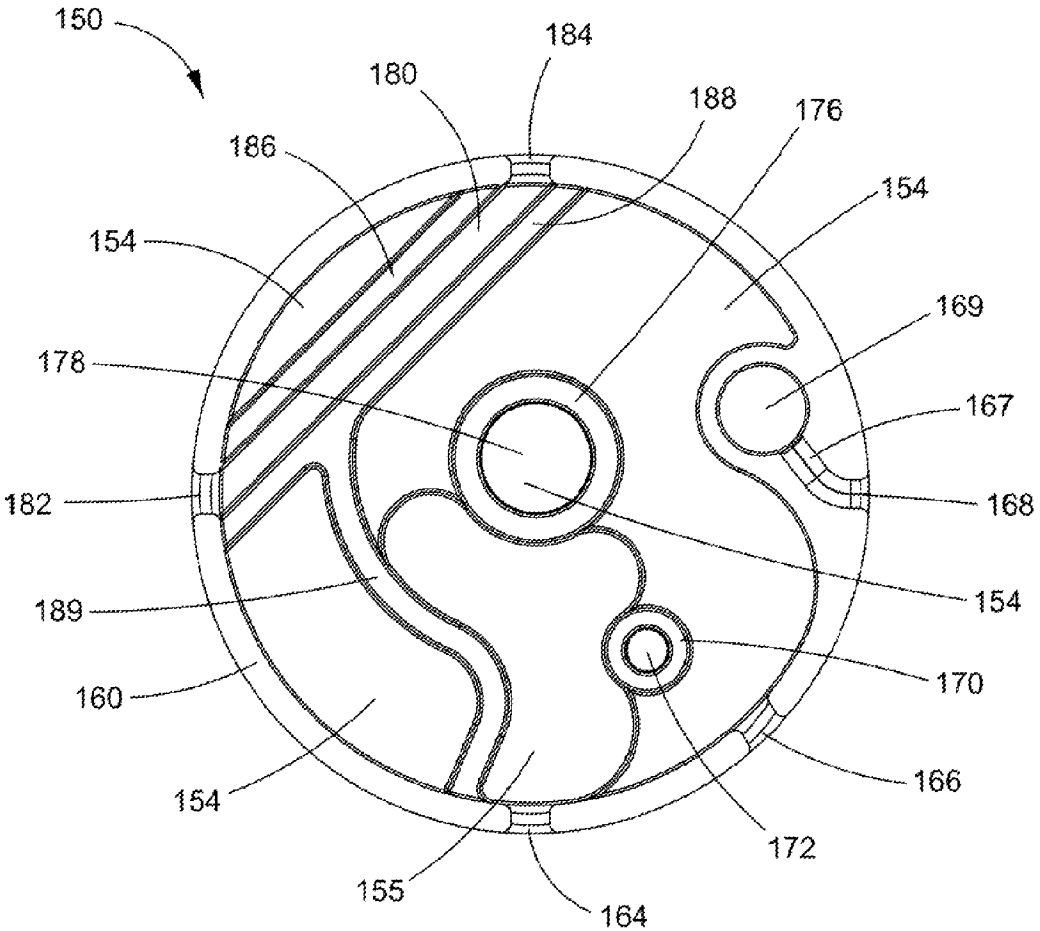
FIG. 4B illustrates a top-down view of the lock component base of FIG. 4A according to one embodiment.

FIG. 4A illustrates a perspective view of the lock component base 150 of lock component 100. FIG. 4B illustrates a top-down view of the lock component base 150 shown in FIG. 4A. The lock, component base 150 includes an internal side base floor 154. The opposite side of the internal side base floor 154 is the external side base floor 152 (see FIG. 5). Base periphery wall 160 surrounds the circumference of the internal side base floor 154 and extends above and perpendicular to the surface of the internal side base floor 154. Three half-circle notches are located on the base periphery wall 160 about the top edge of the base periphery wall 160, the top edge being furthest from connection with the internal, side base floor 154. As shown in the foreground of the lock component base 150 perspective view of FIG. 4A, the left half-circle notch shown is the base side cord access way 164. The right half circle notch shown is the base side portal 168. The center half-circle notch, between the base side cord access way 164 and has side portal 168, is the base side cord tail access way 166. In other embodiments, these notches may be other shapes, as for example rectangle, so that a portion of cord 20 may reside.

Lock component base 150 includes base side depression 169 which is located adjacent to base periphery wall 160. In the preferred embodiment, the base side depression 169 is spherical in shape. The base side depression 169 is enclosed by the internal side base floor 154 at the bottom and almost entirely by walls extending in connection from the base periphery wall 160 around sides of the base side depression 169. Base side tunnel 167 provides access to a side of the base side depression 169. Base side tunnel 167 extends from the side of the base side depression 169 to base side portal 168. In other embodiments, lock component base 150 may include a different shaped base side depression 169 that may be located elsewhere on lock component base 150. For example, the base side depression 169, with base side tunnel 167 and base side portal 168, may be located between supplemental base support wall 189 and second base guide wall 188. In other embodiments, base side depression 169, with base side tunnel 167 and base side portal 168, may not exist in the lock component base 150. In other embodiments, only the base side portal 168 or base side tunnel 167, with the base side portal 168, may exist in the lock component base 150.

Also shown in FIGS. 4A and 4B, internal side base floor 154 includes a base floor recess 155 having a lower surface height than the internal side base floor 154. The reverse side of the base floor recess 155 is the external side base floor 152 (see FIG. 5). The location of the base floor recess 155 in the preferred embodiment, and the difference in surface height of the base floor recess 155 from the surface height of the internal side base floor 154, provides additional vacancy far primary loop 24 of cord knot 21 (see FIG. 14), further described in reference to FIGS. 13 and 14. In other embodiments, a base floor recess may not exist in the lock component base 150. For example, a thinner cord 20 with a smaller cord knot 21 may not require a recess so as to fit within the lock component housing 104. In other embodiments, the base floor recess may be located, elsewhere in the internal side base floor 154, as for example entirely around the primary knot support post 170 and/or secondary knot support post 176 to provide additional room for the entire cord knot 21 (see FIG. 14).

Also shown in FIGS. 4A and 4B, primary knot support post 170 extends above and perpendicular to the surface of the internal side base floor 154 and in proximity to base side cord tail access way 166. In the preferred embodiment, primary knot support post 170 is cylindrical in shape. In the preferred embodiment, primary knot support post 170 is hollow having a primary knot support post cavity 172 located centrally within the primary knot support post 170 and extending the height of the cylinder to a closure at the base of the cylinder at the surface of the internal side base floor 154 inside the primary knot support post 170, in the preferred embodiment, the diameter of the primary not support post 170 is approximately 3.5 mm and the diameter of the primary knot support post cavity 172 is 2 mm. In other embodiments, the cylinder may be hollow having two open ends; including an opening having cavity exposure from the external side base floor 152 (see FIG. 5). ID other embodiments, the diameter of the primary knot support post cavity 172 may be larger or smaller. In other embodiments, a cavity may not exist in the primary knot support post 170. In other embodiments, the diameter of the primary knot support post 170 may be larger or smaller. The primary knot support post 170 may be positioned in a direction closer to the secondary knot support post 176 or base periphery wall 160. For example, larger width cord 20, used in the lock component 100, may necessitate that the primary and secondary knot support posts be positioned further from one another.

Secondary knot support post 176 is also shown in FIGS. 4A and 4B. In the preferred embodiment, secondary knot support post 176 is located approximately at center of the lock component base 150. In other embodiments, the secondary knot support post 176 may located elsewhere in the lock component base 150, so long as cord knot 21 may be placed about the primary knot support post 170 and secondary knot support post 176 within the lock component base 150. In the preferred embodiment, secondary knot support post 176 is cylindrical in shape. In the preferred embodiment, secondary knot support post 176 is hollow having a secondary knot support post cavity 178 located centrally within the secondary knot support post 176 and extending the height of the cylinder, from the opening at the top of the cylinder to closure at the base of the cylinder at the surface of the internal side base floor 154 inside the secondary knot support post 176. In the preferred embodiment, the diameter of the secondary knot support post 176 is approximately 7.5 mm and the diameter of the primary knot support post cavity 178 is 5 mm. In other embodiments, the cylinder may be hollow having two open ends, including and opening at the external side base floor 152 (see FIG. 5). In other embodiments, the diameter of the secondary knot support post cavity 178 may be larger or smaller. In other embodiments, a cavity may not exist in the secondary knot support post 176. In other embodiments, the diameter of the secondary knot support post 176 may be larger or smaller. The secondary knot support post 176 may be positioned in a direction closer to the primary knot support post 170 or base periphery wall 160.

In the preferred embodiment, as shown in FIGS. 4A and 4B, the secondary knot support post 176 is larger in diameter than the primary knot support post 170. The secondary knot support post cavity 178 is also larger in diameter than the primary knot support post cavity 172. In other embodiments, the diameter of either support post or cavity, within a post, may be larger or smaller. The size, including the diameter, of the support post may vary based on the with of the cord 20. The diameter of either cavity within the support posts may be enlarged or constricted based on the size of manufacturing tools used to construct the lock component 100. For example, the primary knot support post cavity 172 and/or secondary support post cavity 178 can accept is peg or other instrument so as to hold the lock component 150 in place when cord 20, including cord knot 21, is positioned within, as further described in reference to FIGS. 12 through 17. In the preferred embodiment, both support posts extend further in height than the base periphery wall 160 from the surface of the internal side base floor 154. In other embodiments, each or both support posts may extend up from internal side base floor 154 at a height less than, greater than, or approximately equal to the height of the base periphery wall 160 from the internal side base floor 154.

In other embodiments, the shape of either or both the primary knot support post 170 and/or secondary knot support post 176 may vary. The posts may be triangular, rectangular, or have more than four flats sides. The cylindrically shaped posts may have different diameters from the base to the top edge of the post along the height. For example, either or both the primary knot support post 170, and/or secondary knot support post 176, may have a smaller diameter near the base of the cylinder approximate to the connection with the internal side base floor 154 that near the top of the cylinder. This would allow cord 20 to fit around the circumference of the post near the base, secured from sliding up along the height of the cylinder since the diameter is wider near the top.

As shown in FIGS. 4A and 4B, a first base guide wall 186 and second base guide wall 188 extend above and perpendicular to the surface of the internal side base floor 154. Both guide walls extend further in height than the base periphery wall 160 from the surface of the internal side base floor 154. In other embodiments, the height of the either or both guide walls may less than, greater than, or approximately equal to the height of the base periphery wall 160 from the internal side base floor 154. Both guide walls connect at their respective ends to the base periphery wall 160. The first base guide wall 186 and second base guide wall 188 are located parallel to each other providing for cord guide channel 180, located between the two walls. The length of the cord guide channel 180 extends from a base side first cord guide channel opening 182 to a base side second cord guide channel opening 184. Both channel openings are formed between the ends of the parallel guide walls at the connection with the base periphery wall 160. Base side first cord guide channel opening 182 and base side second cord guide channel opening 184 are half-circle notches, similar in shape and size to the base side cord access way 164 and base side cord tail access way 166, and located on the upper edge of the base periphery wall 160.

In other embodiments, either one or both guide walls may not exist in the lock component base 150. In other embodiments, more than two guide walls, along with additional cord guide channel openings, may be located within the lock device 100. More than one cord guide channel may thus be provided inside the lock device 100 to run additional portions of cord 20 therethrough.

As shown in FIGS. 4A and 4B, a supplemental base support wall 189 connects to the second base guide wall 188 at one end and to the base periphery wall 160 at the other end and in proximity to the base side cord access way 164. The height of the supplemental base support wall 189 is approximately equal to the height of the second base guide wall 188. In other embodiments, the height of the supplemental base support wall 189 may be greater, equal to, or less than the height of the base periphery wall 160. As shown in FIGS. 4A and 4B, the supplemental base support wall 189 is curved, unlike first base guide wall 186 and second base guide wall 188. In other embodiments, the supplemental base support wall may be straight or have one more angles. In other embodiments, either or both of the first base guide wall 186 and second base guide wall 188 may be curved or have one or more angles. Curved first base guide wall 186 and second base guide wall 188 would provide for a curved cord guide channel 180. Connection of the supplemental base support wall 189 with the base periphery wall 160 is located adjacent to the base side cord access way 164, on a side of the base side cord access way 164, but not on the side located between the base side cord access way 164 and the base side cord tail access way 166, so as not to interfere with placement of the cord knot 21 (see FIG. 14). The curved shape of the supplemental base support wall 189 serves as a guide for the placement of cord 20, including cord knot 21 (see FIG. 13), as further described in reference to FIGS. 12 through 17. In other embodiments, the supplemental base support wall 189 may not exist in the lock device 100 or may be positioned elsewhere in the lock component base 150. For example, as supplemental base support wall may be positioned from an external side of the base side depression 169 to run to the second base guide wall 188, closer in proximity to the base side second cord guide channel opening 184. In other embodiments, more than one supplemental base support wall may be positioned in the lock device 100. The supplemental base support wall 189 may also serve to counter an external force applied to the lock component housing 104 to prevent the housing from snapping or breaking at the seam 102.

Figure 5:
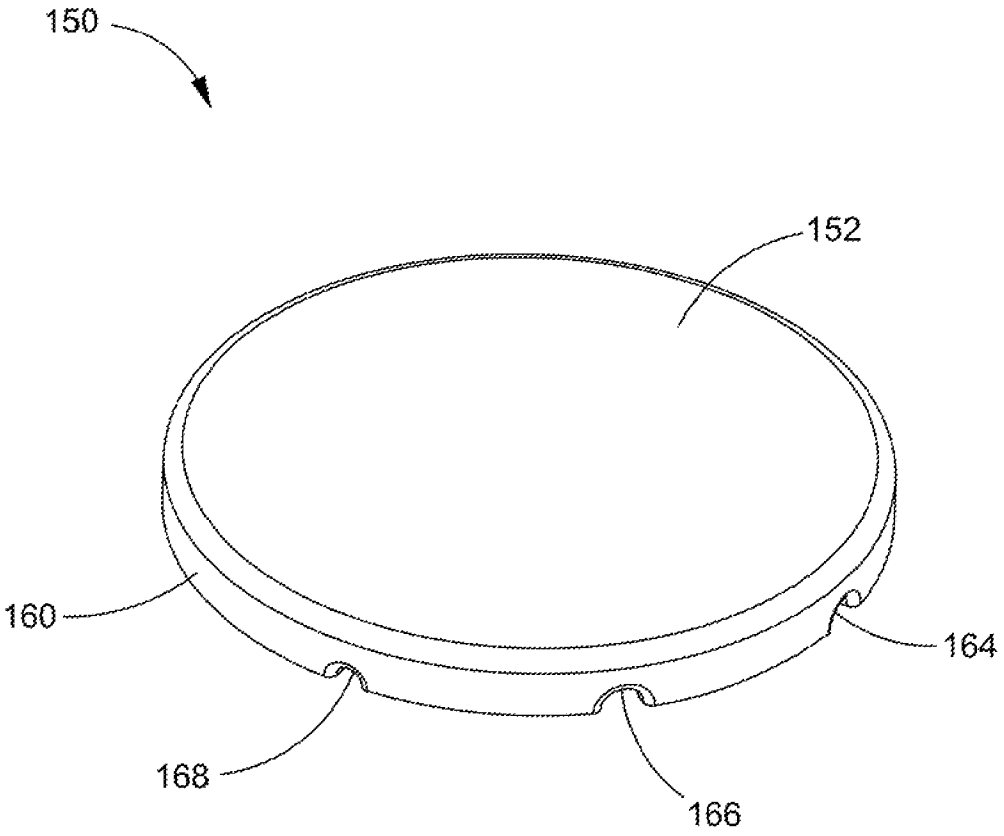
FIG. 5 illustrates a perspective view of the reverse side of the lock component base according to one embodiment.

FIG. 5 illustrates a perspective view of the reverse side of the lock component base 150. The external side base floor 152 and external side of the base periphery wall 160 form the outer external surface of the lock component base 150 forming part of the lock component housing 104. In the preferred embodiment, and as shown in FIG. 5, the external side base floor 152 airfare is flat. In other embodiments, external surface may be rounded, dimpled, smooth, and/or rough.

Figure 6A:
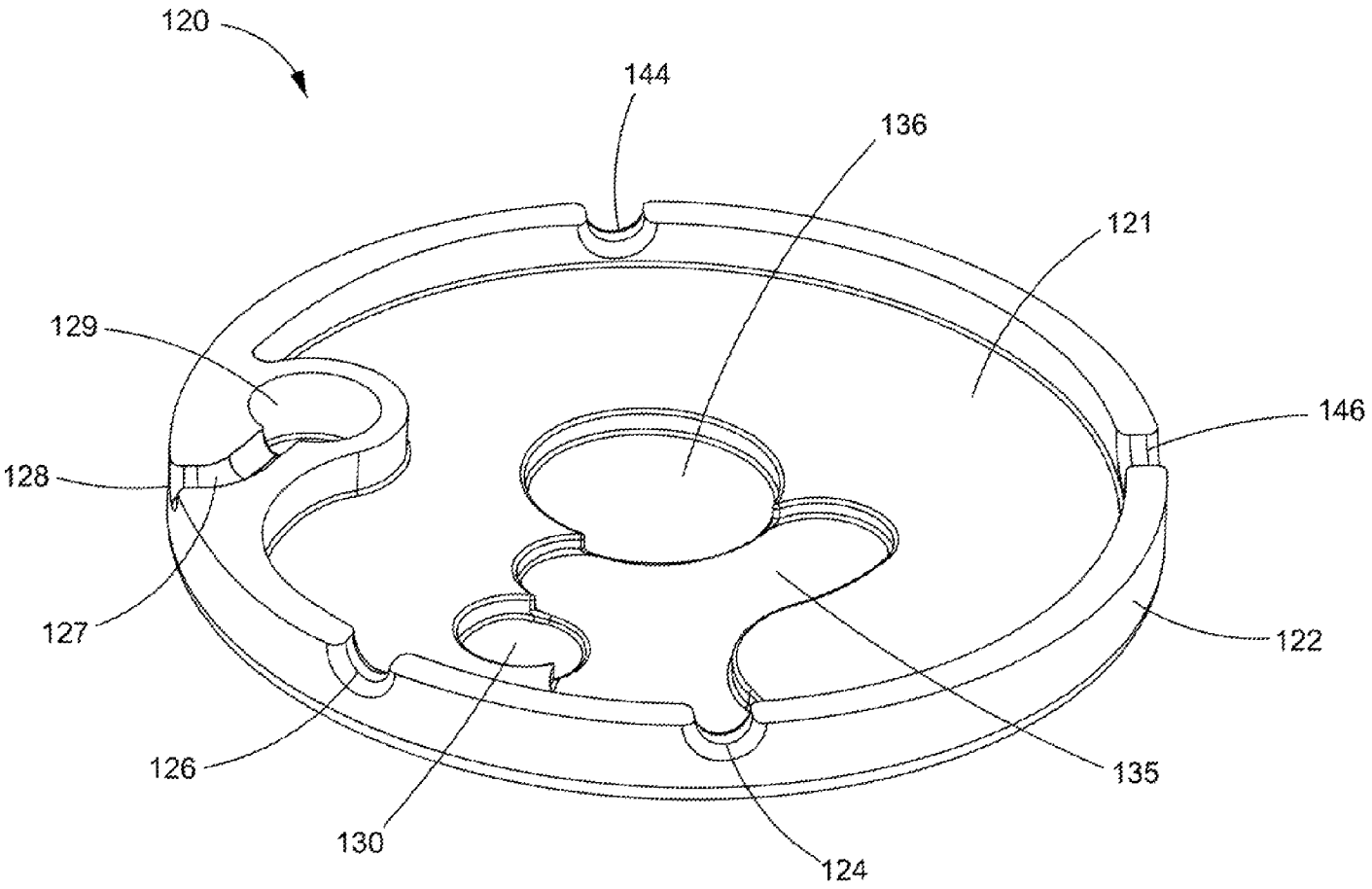
FIG. 6A illustrates a perspective view of the lock component cover of lock component according to one embodiment.
Figure 6B:
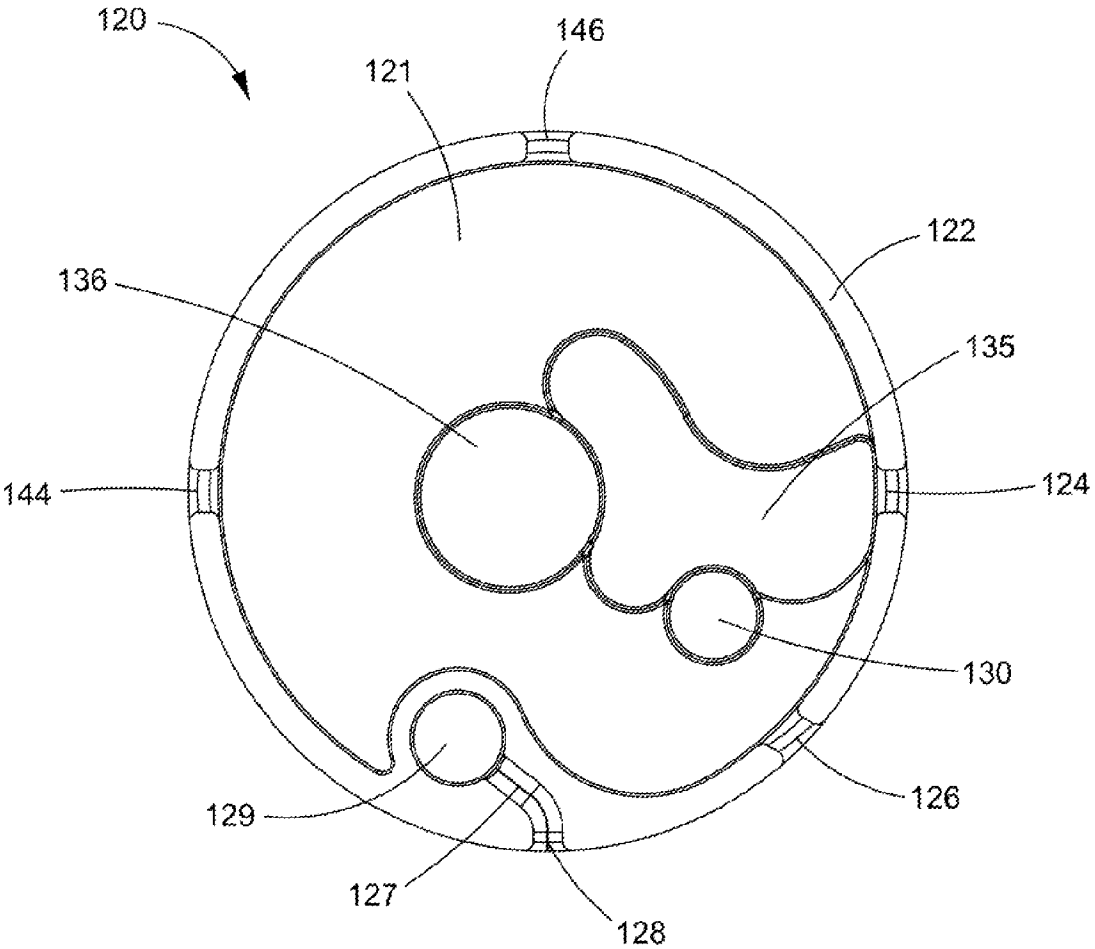
FIG. 6B illustrates a top-down view of the lock component cover of FIG. 6A according to one embodiment.

FIG. 6A illustrates a perspective view of the lock component cover 120 of lock component 100. FIG. 6B illustrates a top-down view of the lock component cover 120 shown in FIG. 6A. The lock component cover 120 includes an internal side cover ceiling 121. The reverse side of the internal side cover ceiling 121 is the external side cover ceiling 123 (see FIG. 7). Cover periphery wall 122 surrounds the circumference of the internal side cover ceiling 121 extending above and perpendicular to the surface of the internal side cover ceiling 121. Five half-circle notches a located on the cover periphery wall 122 about the top edge of the cover periphery wall 122, wherein the top edge is furthest from connection with the internal side cover ceiling 121. As shown in the foreground of the lock component cover 120 perspective view of FIG. 6A, the furthest left half-circle notch shown is the cover side portal 128. The half-circle notch shown centrally in the foreground view is the cover side cord access way 124. The half-circle notch shown between the cover side portal 128 and the cover side cord access way 124 is the cover side cord tail access way 126. The half-circle notch located on the opposite from the cover side portal 128, on the cover periphery wall 122, is the cover side first cord guide channel opening 146. The half-circle notch located on the opposite side from cover side cord access way 124, on the cover periphery wall 122, is the cover side second cord guide channel opening 144. In the preferred embodiment, the half-circle notches located on the lock component cover 120 are approximately equal in size and shape to the half-circle notches shown in FIGS. 4A and 4B. In other embodiments, these notches may not equal the size and shape of notches located, about the base periphery wall 160 of lock component base 150. In other embodiments, these notches may be other shapes, as for example rectangle, so that a portion of cord 20 may reside.

As shown in FIGS. 6A and 6B, cover side depression 129 is located adjacent to cover periphery wall 122. In the preferred embodiment, the cover side depression 129 is spherical in shape. The cover side depression 129 is enclosed by the internal side cover ceiling 121 at the bottom and almost entirely by walls extending in connection from the cover periphery wall 122 around sides of the cover side depression 129. Cover side tunnel 127 provides access to a side of the cover side depression 129. Cover side tunnel 127 extends from the side of the cover side depression 129 to cover side portal 128. In other embodiments, location of the cover depression 129, cover side tunnel 127, and/or cover side portal 128 may be different. Location may coincide with location of the base side depression 169, base side tunnel 167, ardor base side portal 168 for proper alignment of the cover side depression, portal, and tunnel over the base side depression, portal, and cover when the lock component cover 120 is attached to the lock component base 150.

Supplemental ceiling recess 135 is shown as to portion of the internal side cover ceiling 121, having a lower surface height than the internal side cover ceiling 121. The reverse side of the supplemental ceiling recess 135 is the external side cover ceiling 123 (see FIG. 7). The location of the supplemental ceiling recess 135 and the difference in surface height of the supplemental ceiling recess 135 from the surface height of the internal side cover ceiling 121 provides additional vacancy for cord knot 21 (see FIG. 13), further described in reference to FIGS. 12 and 13. In addition, a primary ceiling recess 130 and secondary ceiling recess 136 are located within the internal side cover ceiling 121. As shown in FIGS. 6A and 68, the primary ceiling recess 130 and secondary ceiling recess 136 are shown adjacent to the supplemental ceiling recess 135. The primary ceiling recess 130 and secondary ceiling recess 136 are lower in height, and thus recessed further, than the internal side cover ceiling 121 and supplemental ceiling recess 135. The diameter of the primary ceiling recess 130 is slightly larger than the diameter of the primary knot support post 170. The diameter of the secondary ceiling recess 136 is slightly larger than the diameter of the secondary knot support post 176. In other embodiments, location of the primary ceiling recess 130, secondary ceiling recess 136, and/or supplemental ceiling recess 135 may depend on the location of the primary knot support post. 172, secondary knot support post 176, and/or base floor recess 155 for proper alignment and fitting of the lock component cover 120 with the lock component base 150. In other embodiments, the primary ceiling recess 130, secondary ceiling recess 136, and/or supplemental ceiling recess 135 may not exist in the lock component cover 120. In other embodiments, more than one supplemental ceiling recess 135 may be located in the internal side cover ceiling 121.

The lock component housing 104 is formed when the lock component cover 120 is placed over the lock component base 150. For proper fitting, the lock component cover 120 may be arranged so as to align with the lock component housing 104. The end of the cylinder shaped primary knot support post 170, opposite the end connected with the internal side base floor 154, may fit into the diameter of the primary ceiling recess 130. The end of the cylinder shaped secondary knot support post 176, opposite the end connected with the internal side base floor 154, may fit into the diameter of the secondary ceiling recess 136. To secure the lock component cover 120 to the lock component base 150, adhesive may be applied on either or both of the top end of the primary knot support post 170 or on the surface of the primary ceiling recess 130 to secure connection between the primary knot support post 170 and the primary ceiling recess 130. Alternatively or in addition, adhesive may be applied on either or both of the top end of the secondary knot support post 176 or on the surface of the secondary ceiling recess 136 to secure connection between the secondary knot support post 17 and the secondary ceiling recess 136. Proper connection of the lock component cover 120 on to the lock component base 150 to form the lock component housing 104 would result from the alignment of the cover side cord access way 124 directly over the base side cord access way 164 to form cord access way 114 of the lock component 100 (see FIG. 3). Cover side cord tail access way 126 aligns over base side cord tail access way 166 to form cord tail access way 116 (see FIG. 3). Cover side portal 128 aligns over has side portal 168 to form portal 118; cover side tunnel 127 aligns over base side tunnel 167; and cover side depression 129 aligns directly over base side depression 169. In addition for proper alignment of the lock component cover 120 over the lock component base 150, the cover side first cord guide channel opening 146 aligns over the base side first cord guide channel opening 182 to form the first cord guide channel opening 110 (see FIG. 17). The cover side second cord guide channel opening 144 aligns over the base side second cord guide channel opening 184 to form the second cord guide channel opening 112 (see FIG. 17). Adhesive may also be applied on the top edge of either or both the base periphery wall 160 and/or cover periphery wall 122 for fixed attachment of the lock component base 150 and lock component cover 120. In other embodiments, one or some of cord access way 114, cord tail access way 116, portal 118, first cord guide channel opening 110, and/or second cord guide channel opening 112 may be fully located on the periphery of either the lock component cover 120 or lock component base 150, so as not to be only formed when the lock, component cover 120 is attached to the lock component base 150.

Figure 7:
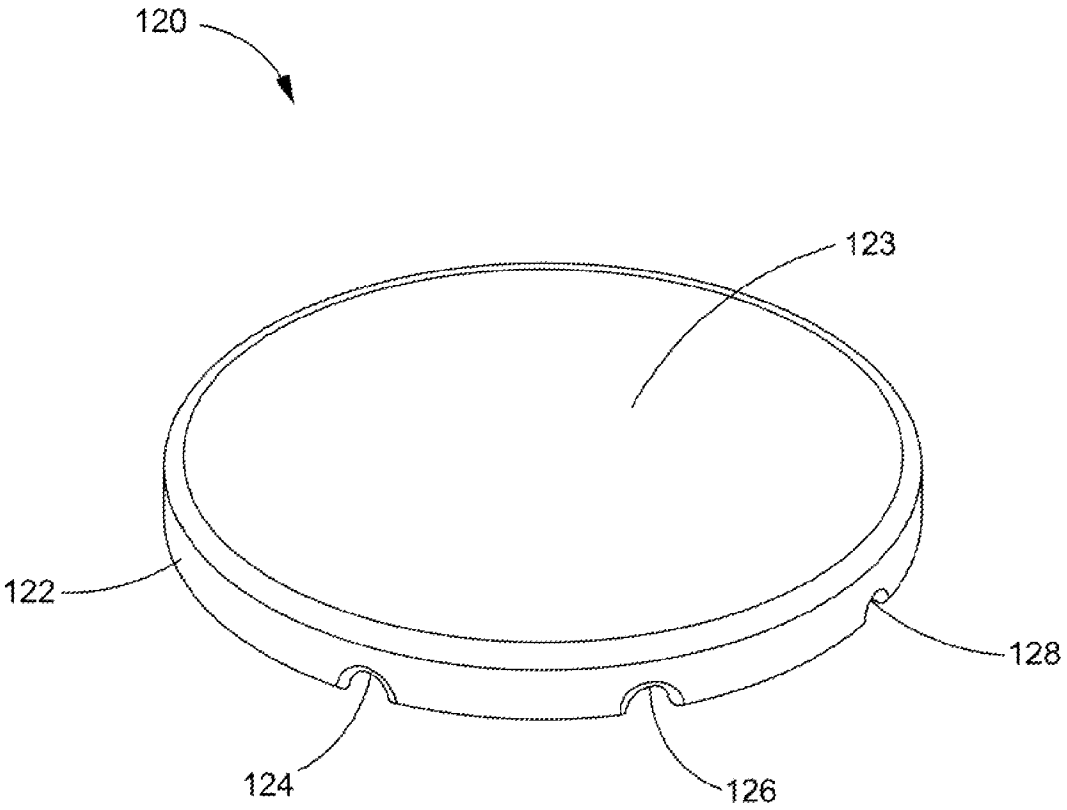
FIG. 7 illustrates a perspective view of the reverse side of the lock component cover according to one embodiment.

FIG. 7 illustrates a perspective view of the reverse side of the lock component cover 120. The external side cover ceiling 123 and external side of the cover periphery wall 122 form the outer external surface of the lock component cover 120 forming part of lock component housing 104. In the preferred embodiment, and as shown in FIG. 7, the external side cover ceiling 123 surface is flat. In other embodiments, external surface may be rounded, dimpled, smooth, and/or rough.

In other embodiments, particular pieces formed in the lock component base 150 may alternatively or additionally be formed in the lock component cover 120 and vice versa. For example, primary knot support post 170 and secondary knot support post 176 may be located in the lock component base 150 and the first base guide wall 186 and second base guide wall 188 located in the lock component cover 120. Supplemental base support wall 189 may be located in the lock component cover 120, or additional base support walls may be located in the lock component cover 120 and/or lock component base 150. Any arrangement of pieces may exist between lock component base 150 and lock component cover 120.

Figure 8A:
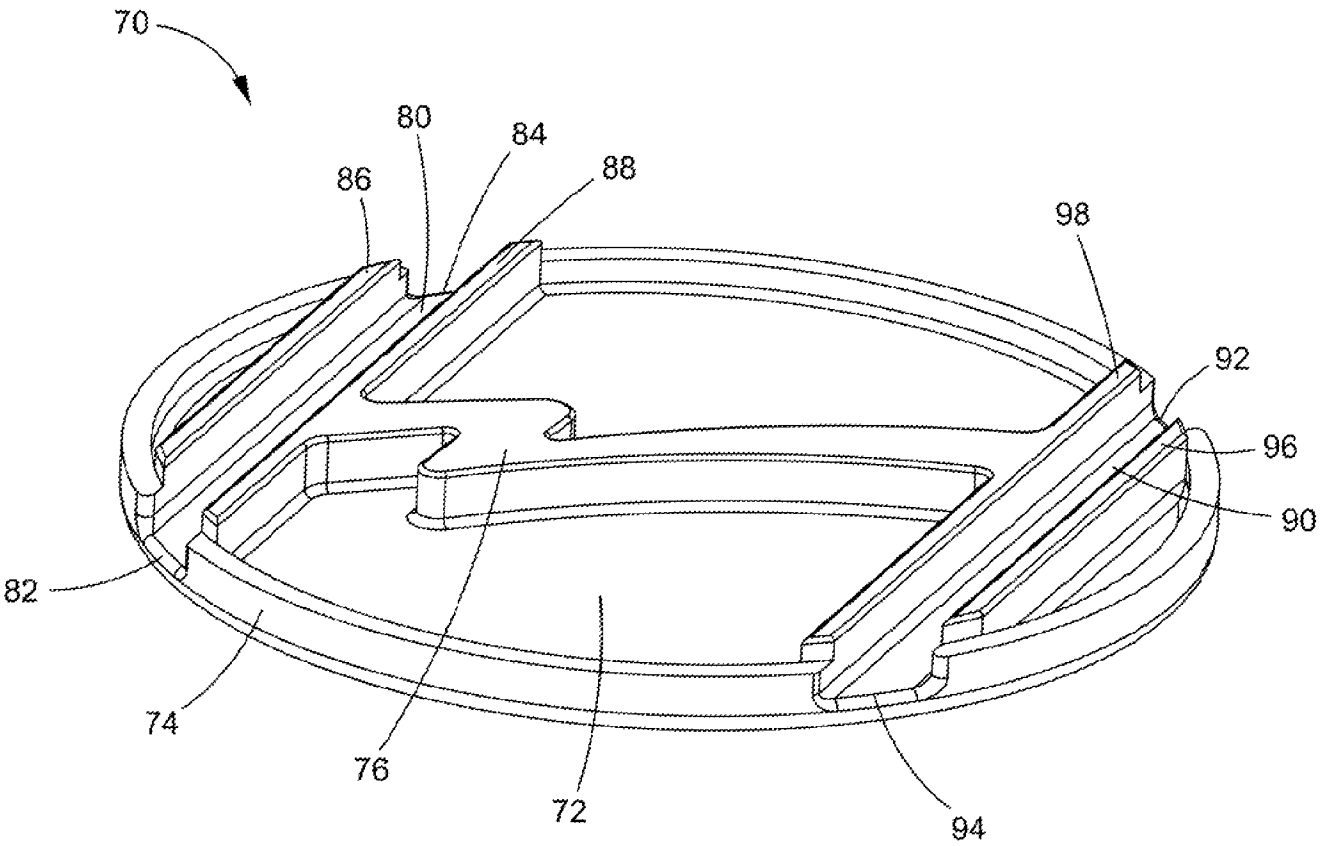
FIG. 8A illustrates a perspective view of the crossover component base of crossover component according to one embodiment.
Figure 8B:
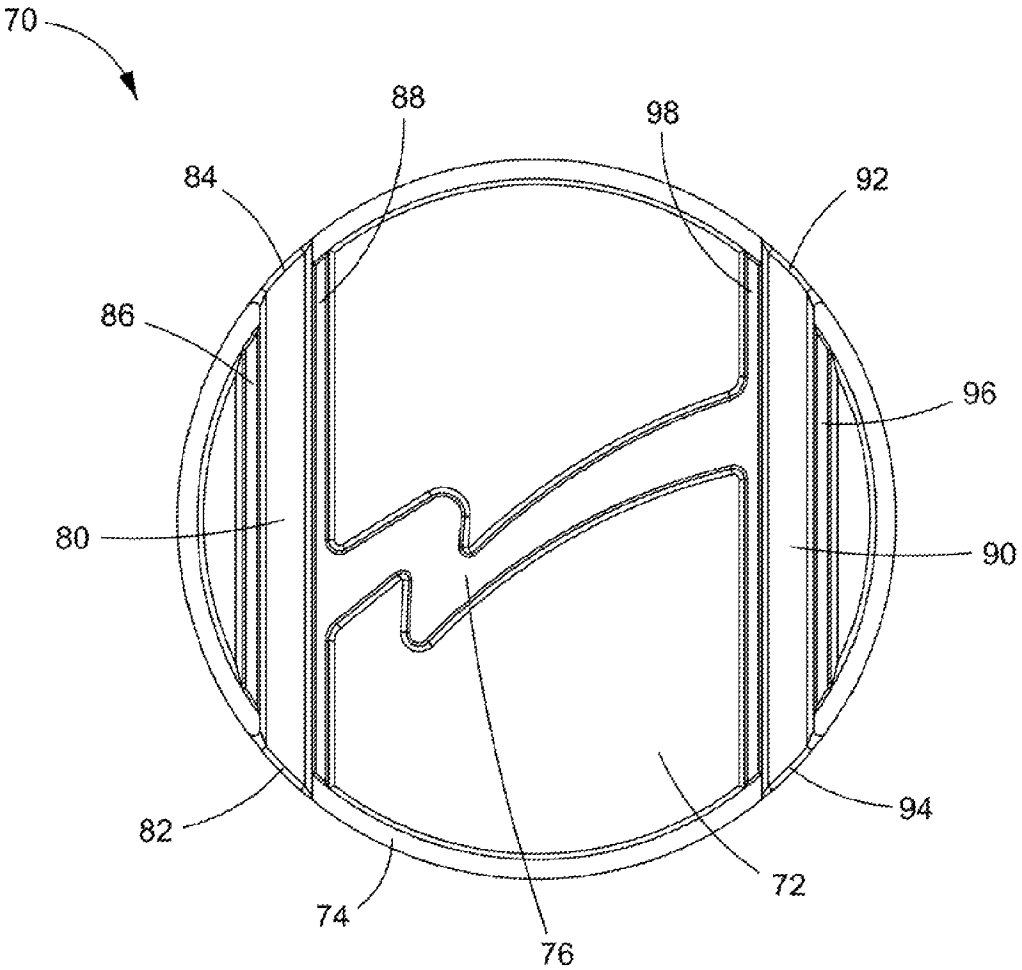
FIG. 8B illustrates a top-down view of the crossover component base of FIG. 8A according to one embodiment.

FIG. 8A illustrates a perspective view of the crossover component base 70 of crossover component 50. FIG. 8B illustrates a top-down view of the crossover component base 70 shown in FIG. 8A. The crossover component base 70 includes a crossover internal side base floor 72. The reverse side of the crossover internal side base floor 72 is the crossover external side base floor 73 (see FIG. 9). Crossover base periphery wall 74 surrounds the circumference of the crossover internal side base floor 72 extending above and perpendicular to the surface of the crossover internal side base floor 72. Four half-rectangular notches are located on the crossover base periphery wall 74 about the top edge of the crossover base periphery wall 74, wherein the top edge is furthest from connection with the internal side base floor 72. As shown in the foreground of the crossover component base 70 perspective view of FIG. 8A, the left half-rectangular notch shown is the base side first crossover cord guide channel opening 82. The right half-rectangular notch shown is the foreground is the base side fourth crossover cord guide channel opening 94. First crossover cord guide channel 80 runs from the base side first crossover cord guide channel opening 82, between two parallel guide walls, to the base side second crossover cord guide channel opening 84. Second crossover cord guide channel 90 runs from the base side fourth crossover cord guide channel opening 94, between two other parallel guide walls, to the base side third crossover cord guide channel opening 92.

As shown in FIGS. 8A and 8B, a first outside guide wall 86 and first inside guide wall 88 extend above and perpendicular to the surface of the crossover internal side base floor 72. Both guide walls extend further in height than the crossover base periphery wail 74 from the surface of the crossover internal side base floor 72. Both guide walls connect at each end to the crossover base periphery wall 74. The first outside guide wall 86 and first inside guide wall 88 are located parallel to each other providing a first crossover cord guide channel 80, located between the two walls. The length of the first crossover cord guide channel 80 extends between the base side first crossover cord guide channel opening 82 to the base side second crossover cord guide channel opening 84. Both channel openings are formed between the ends of the parallel guide walls at the connection with the crossover base periphery wall 74, on the top edge of the crossover base periphery wall 74.

As shown in FIGS. 5A and 5B, a second outside guide wall 96 and second inside guide wall 98 extend above and perpendicular to the surface of the crossover internal side base floor 72. Both guide walls extend further in height than the crossover base periphery wall 74 from the surface of the crossover internal side base floor 72. Both guide walls connect at each end to the crossover base periphery wall 74. The second outside guide wall 96 and second inside guide wall 98 are located parallel to each other providing a second crossover cord guide channel 90, located between the two walls. The length of the second crossover cord guide channel 90 extends between the third base side crossover cord guide channel opening 92 to the base side fourth crossover cord guide channel opening 94. Both channel openings are formed between the ends of the parallel guide walls at the connection with the crossover base periphery wall 74, above the crossover base periphery wall 74.

As shown in FIGS. 8A and 8B, first crossover cord guide channel 80 is approximately equal in width, depth, and length to second crossover cord guide channel 90. The first crossover cord guide channel 80 is parallel to the second crossover cord guide channel 90 and is located at an approximately equal distance from the center of the crossover component base 70. In other embodiments, first crossover cord guide channel 80 and second crossover cord guide channel 90 may be located closer to one another. In other embodiments, first crossover cord guide channel 80 and second crossover cord guide channel 90 may not be parallel. In other embodiments, first crossover cord guide channel 80 and second crossover cord guide channel 90 may intersect such that a portion of cord 20 crosses above or below another portion of cord 20. In other embodiments, only one crossover cord guide channel exists. In one example, with only one crossover cord guide channel in the crossover component 50, a portion of cord 20 may run along one or more additional portions of cord 20 in the same channel. The one crossover cord guide channel may be wider to accompany multiple portions of cord 20. In other embodiments, three or more cord guide channels may be located within the crossover component 50. In other embodiments, the height of the one or more guide walls in the crossover component base 70 may be shorter or approximately equal to the height of the crossover base periphery wall 74. In other embodiments, cord guide channels may not exist and cord 20 may rest between openings in the crossover component housing 54.

As shown in FIGS. 8A and 8B, a crossover base support wall 76 connects at one end to the first inside guide wall 88 and at the other end to the second inside guide wall 98. The height of the crossover base support wail 76 is approximately equal to the height of the first inside guide wall 88 and second inside guide wall 98. In other embodiments, the height of the crossover base support wall 76 may be shorter or higher than the height of the first inside guide wall 88 and second inside guide wall 98. As shown in FIGS. 8A and 8B, the crossover base support wall 76 runs generally perpendicular to the first inside guide wall 88 and second inside guide wall 98. The crossover base support wall 76, as shown in FIG. 8A, is designed with multiple curves. In other embodiments, the crossover base support wall 76 may be a straight with no curves. The crossover base support wall 76 serves to support the crossover component housing when the crossover component cover 61) is attached to the crossover component base 70. The crossover base support wall 76 supports the vacancy near center of the crossover component housing 54 so that force applied about the center of the crossover component housing 54 externally on the crossover external side base floor 73 (see FIG. 9) and/or on the crossover cover external side ceiling 65 (see FIG. 11) may not snap or break connection of the crossover component base 70 and crossover component cover 60 along the periphery walls of the crossover component housing 54. In other embodiments, two or more crossover base support walls may be incorporated. In other embodiments, the crossover base support wall 76 may be located in any position on the crossover internal side base floor 72. For example, the crossover base support wall 76 may be located in parallel to the first and second cord guide channels and connected at the ends to the crossover base periphery wall 74. In other embodiments, the crossover base support wall 76 may not connect on one or both ends within the crossover component base 70. For example, the crossover base support wall 76 may be a cylinder or rectangle, or any other shaped piece extending up from the crossover internal side base floor 72.

Figure 9:
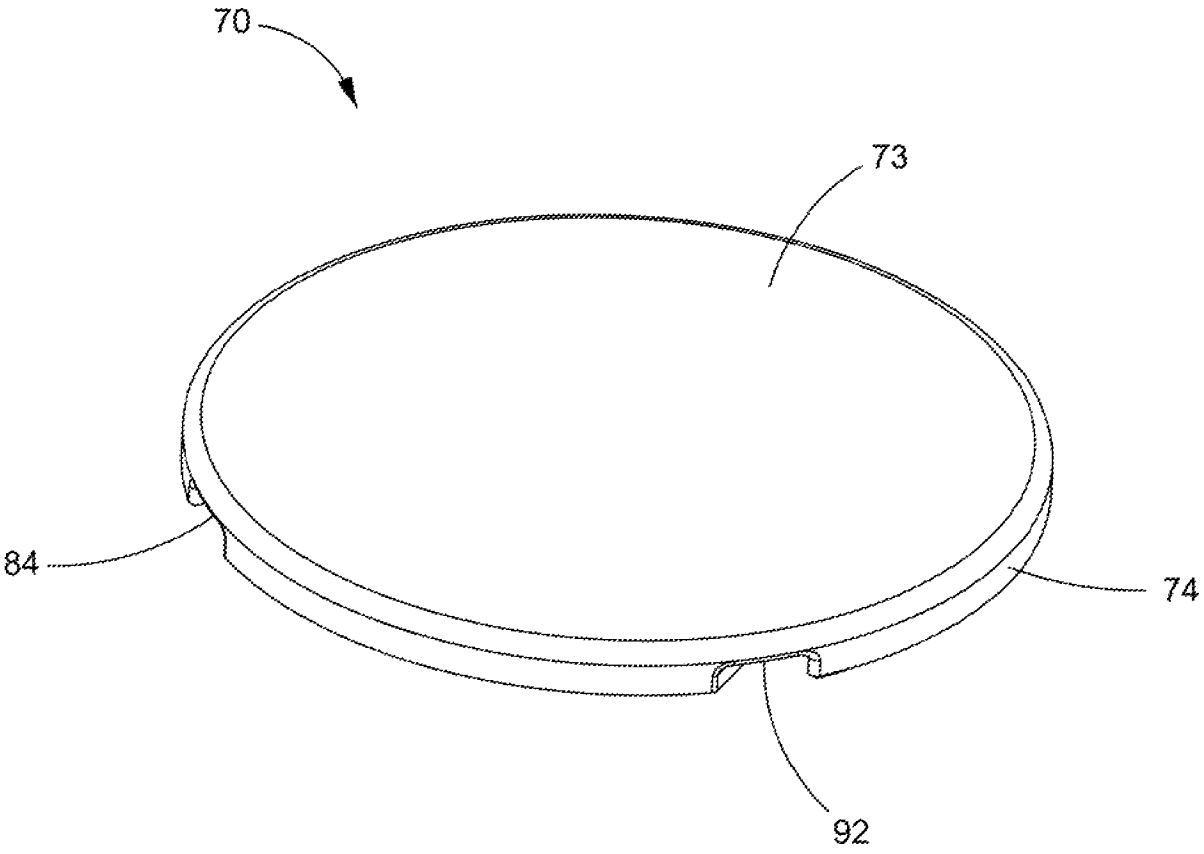
FIG. 9 illustrates a perspective view of the reverse side of the crossover component base according to one embodiment.

FIG. 9 illustrates a perspective view of the reverse side of the crossover component base 70. The crossover external side base floor 73 and external side of the crossover base periphery wall 74 form part of the outer external surface crossover component housing 54. In the preferred embodiment, and as shown in FIG. 9, the crossover external side base floor 73 surface is flat. In other embodiments, external surface may be rounded, dimpled, smooth, and/or rough.

Figure 10:
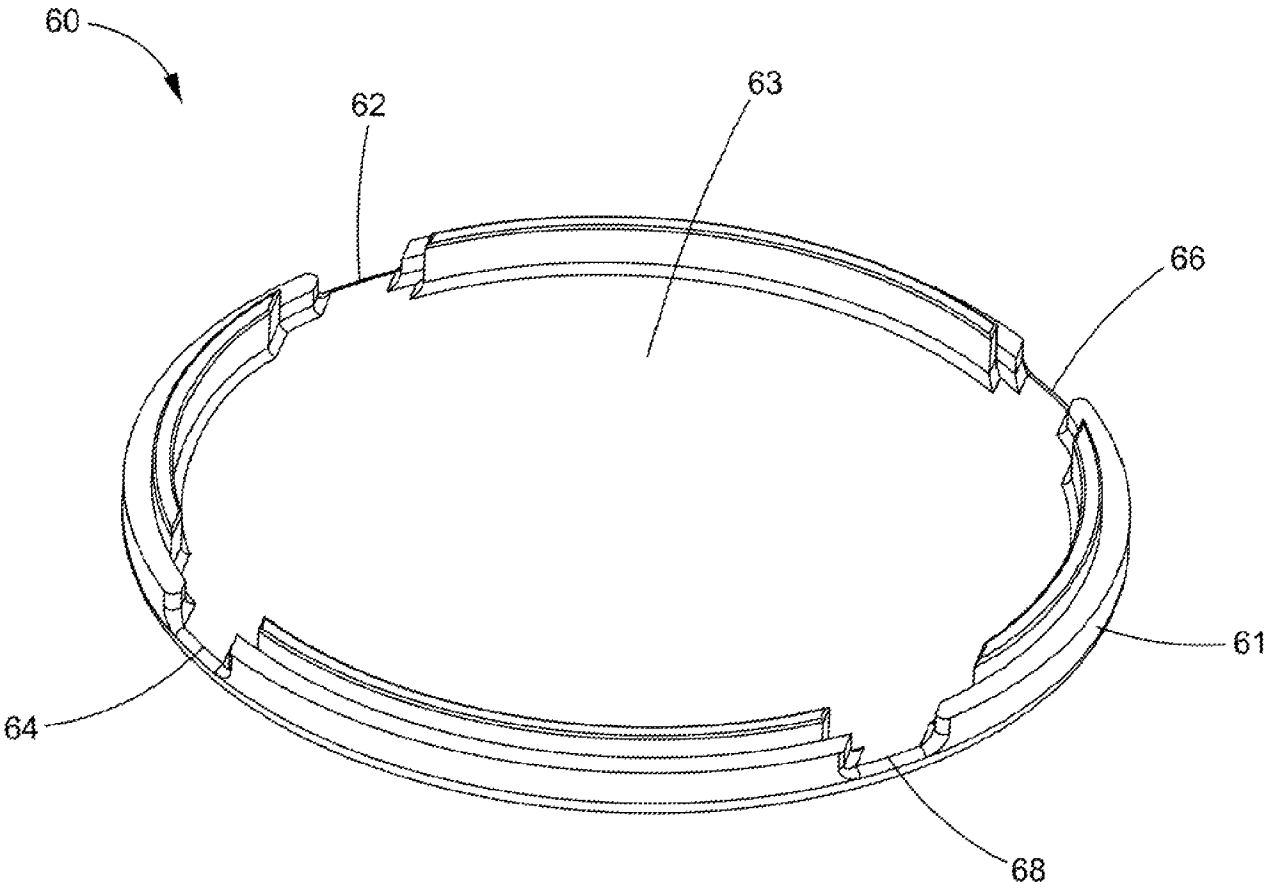
FIG. 10 illustrates a perspective view of the crossover component cover of crossover component according to one embodiment.

FIG. 10 illustrates a perspective view of the crossover component cover 60 of crossover component 50. The crossover component cover 60 includes a crossover internal side cover ceiling 63. The reverse side of the crossover internal side cover ceiling 63 is the crossover external side cover ceiling 65 (see FIG. 11). Crossover cover periphery wall 61 surrounds the circumference of the crossover internal side cover ceiling 63 extending above and perpendicular to the surface of the crossover internal side cover ceiling 63. Four half-rectangular notches are located on the crossover cover periphery wall 61 about the top edge of the crossover cover periphery wall 61, wherein the top edge is furthest from connection with the crossover internal side cover ceiling 63. As shown in the foreground of the crossover component cover 60 perspective view of FIG. 10, the furthest left half-rectangular notch shown is the cover side second crossover cord guide channel opening 64. The half-rectangular notch shown right of the cover side second crossover cord guide channel opening 64 in the foreground view is the cover side third crossover cord guide channel opening 68. The half-rectangular notch located on the opposite side of the crossover component cover 60, across the diameter of the crossover component cover 60, from the cover side second crossover cord guide channel opening 64, on the crossover cover periphery wall 61, is the cover side fourth crossover cord guide channel opening 66. The half-rectangular notch located, on the opposite side of the crossover component cover 60 across the diameter of the crossover component cover 60, from the cover side third crossover cord guide channel opening 68, on the crossover cover periphery wall 61, is the cover side first crossover cord guide channel opening 62. In the preferred embodiment, the half-rectangular notches located on the crossover component cover 60 are approximately equal in size and shape to the half-rectangular notches shown in FIGS. 8A and 8B of the crossover component base 70. In other embodiments, these notches may not equal the size and shape of notches located about the crossover base periphery wall 74 of crossover component base 70. In other embodiments, these notches, whether on the crossover cover periphery wall 61 or crossover base periphery wall 74, may be other shapes, as for example circular, so that a portion of cord 20 may reside.

As shown in FIG. 10, the crossover internal side cover ceiling 63 has a flat surface. In other embodiments, the ceiling 63 may have recessed portions, as for example running between the cover side second crossover cord guide channel opening 64 to the cover side first crossover cord guide channel opening 62 and from the cover side third crossover cord guide channel opening 68 to the cover side fourth crossover cord guide channel opening 66. These recessed portions might provide a channel to support larger width cord 20 that may not fully fit in the first crossover cord guide channel 80 or second crossover cord guide channel 90 of FIG. 8A. In another embodiments, and in addition to or in alternative of recessed portions on the crossover internal side cover ceiling 63, to support cord 20, guide walls may exist on the surface of the crossover internal side cover ceiling 63. A pair of guide walls may run each from cover side second crossover cord guide channel opening 64 to the cover side first crossover cord guide channel opening 62 and from the cover side third cord crossover guide channel opening 68 to the crossover cover side fourth cord guide channel opening 66. The distance between the guide channels in each pair may match the width of the openings thus forming additional guide height when aligned over the guide walls of the crossover component base 70 (see FIG. 8A).

The crossover component housing 54 is formed when the crossover component cover 60 is placed over the crossover component base 70. For proper fitting, the crossover component cover 60 may be arranged so as to align with the crossover component base 70. Proper connection of the crossover component cover 60 on to the crossover component base 70 to form the crossover component housing 54 would result from the alignment of the cover side first crossover cord guide channel opening 62 directly over the base side first crossover cord guide channel opening 82 to form first crossover cord guide channel opening 42 of the lock component 100 (see FIG. 3). Cover side second crossover cord guide channel opening 64 directly aligns over base side second crossover cord guide channel opening 84 to form second crossover cord, guide channel opening 44 (see FIG. 17). Cover side fourth crossover cord guide channel opening 66 directly aligns over base side fourth crossover cord guide channel opening 94 to form third crossover cord guide channel opening 46. Cover side third crossover cord guide channel opening 68 directly aligns over base side third crossover cord guide channel opening 92 (see FIG. 17) to form fourth crossover cord guide channel opening 48. The crossover component cover 60 connects with the crossover component base 70 along the top edge of the crossover base periphery wall 74 with the top edge of the crossover cover periphery wall 61 (see FIG. 3). In some embodiments, adhesive may be applied to the top edge of the either or both the crossover base periphery wall 74 and/or crossover cover periphery wall 61 to secure connection of the crossover component base 70 with the crossover component cover 60 forming the crossover component housing 54 at the crossover component housing seam 52 (see FIG. 3). In other embodiments, one or some of the first cord guide channel opening 42, second crossover cord guide channel opening 44, third crossover cord guide channel opening 46, and/or fourth crossover cord guide channel opening 48 may be fully located on the periphery of either the crossover component cover 60 or crossover component base 70 so as not to be only formed when the crossover component cover 60 is attached to the crossover component base 70.

Figure 11:
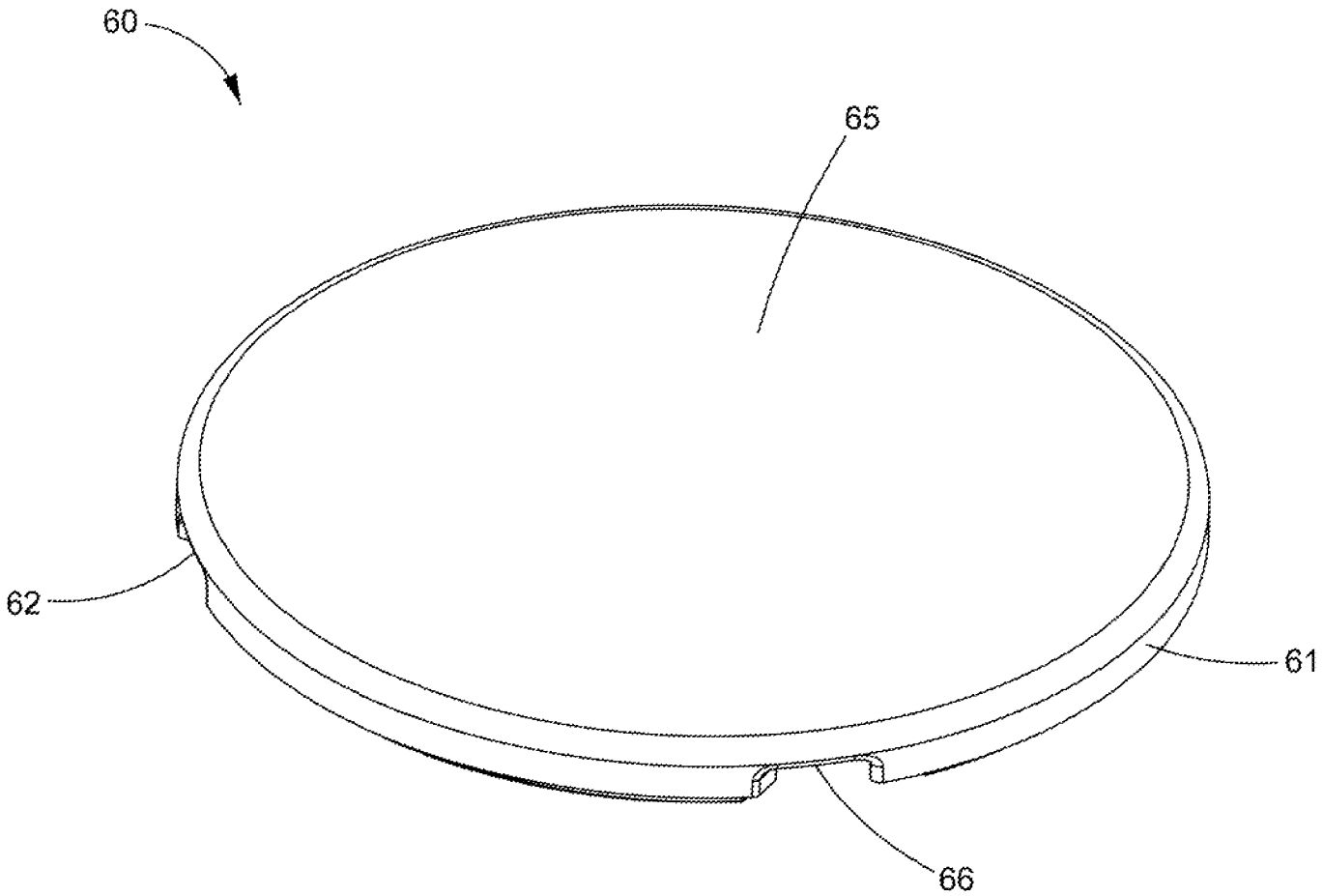
FIG. 11 illustrates a perspective view of the reverse side of the crossover component cover according to one embodiment.

FIG. 11 illustrates a perspective view of the reverse side of the crossover component cover 60. The crossover external side cover ceiling 65 and external side of the crossover cover periphery wall 61 form part of the crossover component housing 54. In the preferred embodiment, and as shown in FIG. 11, the crossover external side cover ceiling 65 has a flat surface. In other embodiments, external surface may be rounded, dimpled, smooth, and/or rough.

In other embodiments, particular pieces formed in the crossover component base 70 may alternatively or additionally be formed in the crossover component cover 60 and vice versa. For example, first outside guide wall 86, first inside guide wall 88, second outside guide wall 96, and second inside guide wall 98 may be located in the crossover component base 70 and the crossover base support wall 76 located in the crossover component cover 60. In another example, inside guide walls may be located in the crossover component cover 60 with outside crossover guide walls located in the crossover component base 70 so that first crossover cord guide channel 80 and second crossover cord guide channel 90 are conned after the crossover cover 60 is connected to the crossover component base 70. Any arrangement of pieces may exist between crossover component cover 60 and crossover component base 70.

Figure 12:
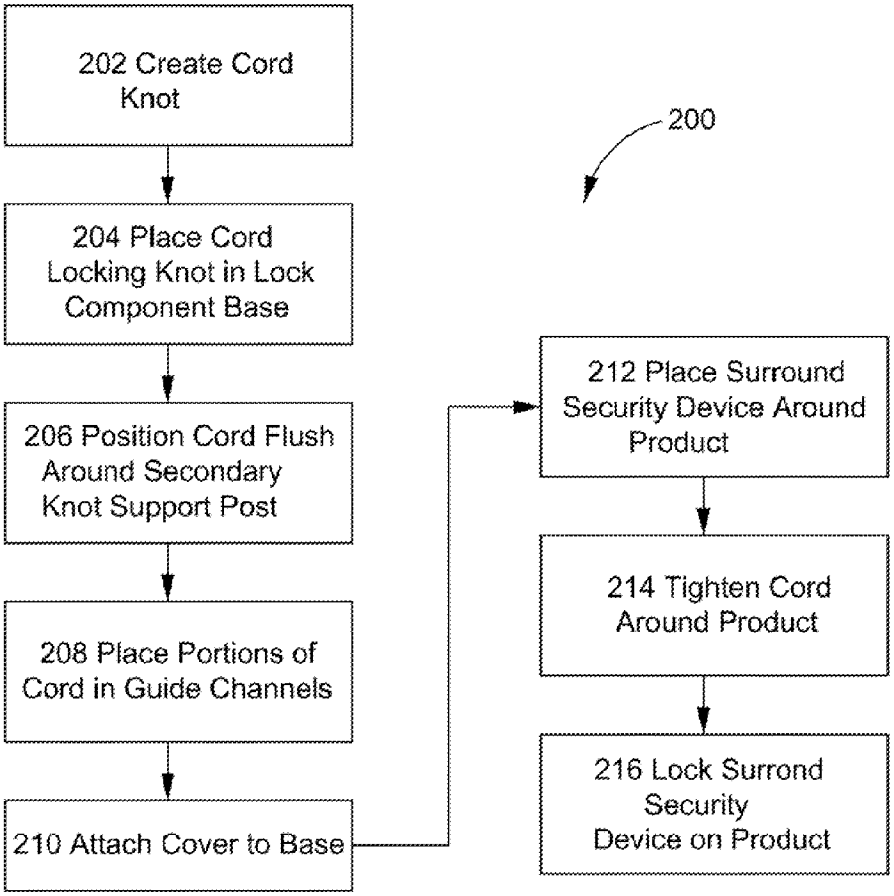
FIG. 12 illustrates a process for creating the surround security device and applying the device on a product according to one embodiment.

FIG. 12 illustrates process 200 for creating the surround security device 10 and applying the device 10 on a product. FIGS. 13 through 17 may be viewed in conjunction with the process illustrated in FIG. 12.

As shown in FIG. 12, cord knot 21 is created at step 202. Cord 20, used in the surround security device 10, may be any one of, but not limited to: string; twine; cable; wire; or monohim. An example of mono-film may be fishing wire. Cord 20 may be rigid or elastic. Material within the cord 20 may contain, but is not limited to: metallic properties, such as steel; plastic; cloth; rubber, wool, silk, multi-threaded material, and/or fabric.

Figure 13:
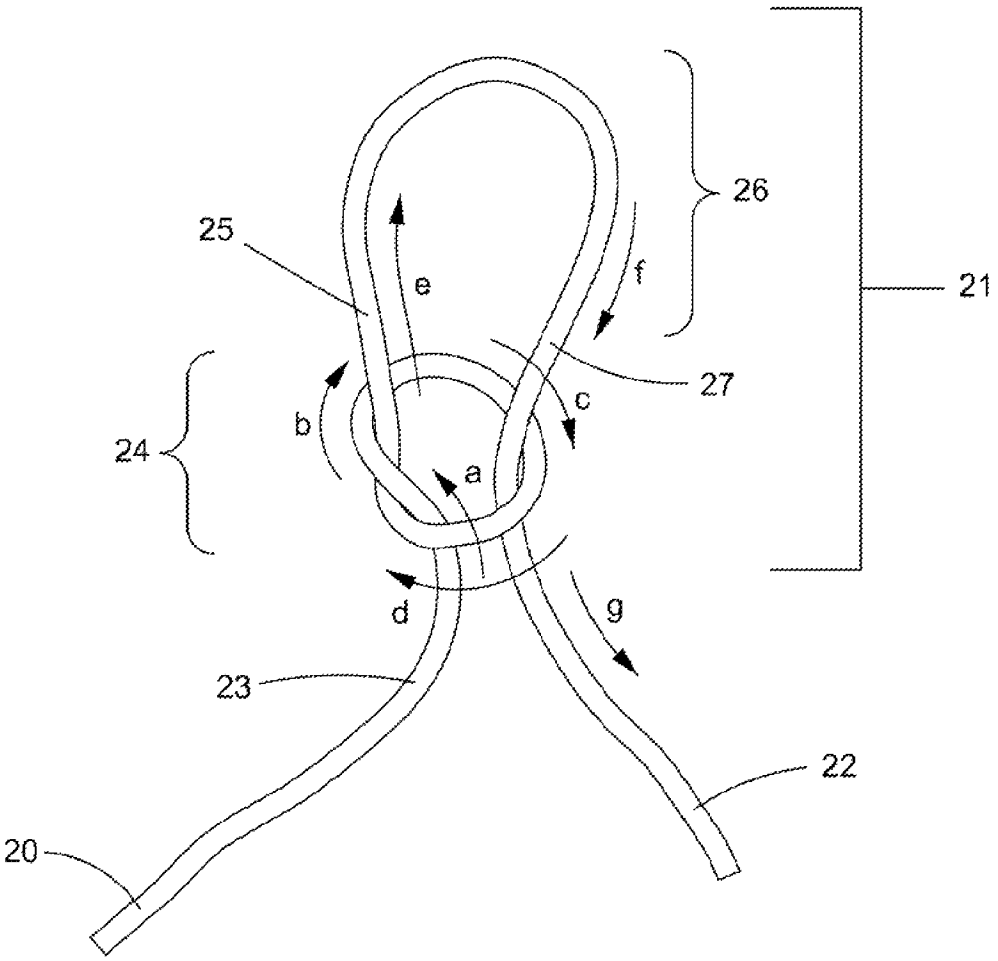
FIG. 13 illustrates a formed cord knot from the cord according, to one embodiment.

FIG. 13 illustrates formed cord knot 21 with cord 20. Cord tad 22 is shown as one end of cord 20 in FIG. 13. Cord knot 21 represents a portion of cord 20. The remainder of the cord 20 to cord head 27 (see FIG. 17) is not shown in FIG. 13.

To form the cord knot 21 at step 202, cord tail 22 is wrapped once under and around a portion of cord 20 and then pulled through to form primary loop 24. Primary loop 24 runs, as shown in FIG. 13, beginning at the location on the cord 24) labeled primary loop entrance cord 23. Primary loop entrance cord 23 is the portion of cord adjacent to cord knot 21 near primary loop 24. Primary loop entrance cord 23 is shown entering primary loop 24 in direction a under a portion of cord 20 running in direction d. The primary loop entrance cord 23 is shown running from direction a to direction b over and then under a portion of cord 22 running in direction e to the location on the cord 20 labeled primary loop exit cord 25. Cord 20 running in direction b then runs in direction e behind cord 20, running in direction f, and over top cord 20 running in direction g to form the primary loop 24. From direction c, same cord 20 wraps underneath cord 20 about primary loop entrance cord 23 in direction a, in direction d. From direction d, cord 20 exits the primary loop 24 above cord 20, running in direction a, to location of primary loop exit cord 25. A secondary loop 26 is formed by cord 20 between location of primary loop exit cord 25 and secondary loop exit cord 27, beginning with cord 20 running in direction e and then ending where cord 20 re-enters primary loop 24 in direction f. Cord 20 runs from direction f through the primary loop 24 and exits primary loop 24 in direction g. Cord 20 exiting the primary loop 24 in direction g is labeled cord tail 22. The knot created by cord 20, consisting of the primary loop 24 and secondary loop 26, is the cord knot 21, as shown in FIG. 13.

Figure 14:
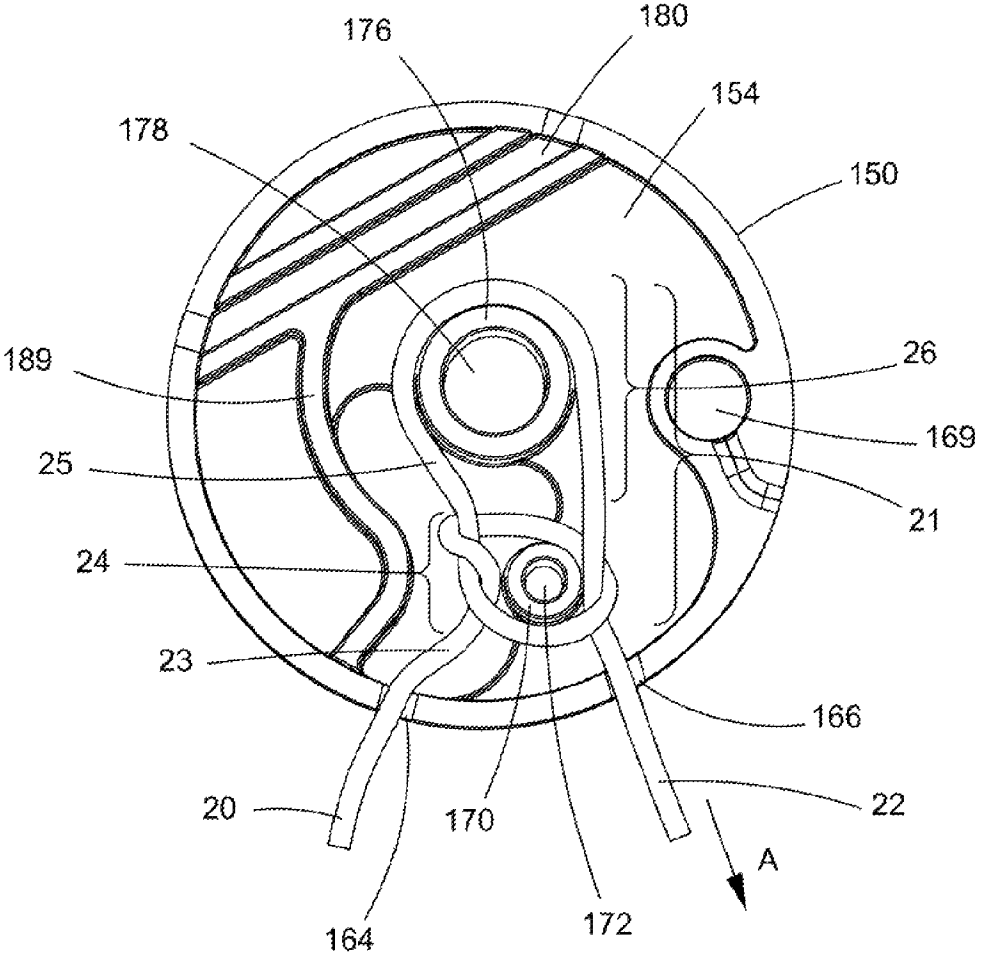
FIG. 14 illustrates the cord knot positioned inside the lock component base according to one embodiment.

Referring again to FIG. 12, at step 204 the cord knot 21 is placed in lock component base 150. FIG. 14 illustrates the cord knot 21 positioned inside the lock component base 154) of lock component 100. At step 204, the cord knot 21 is placed within the lock component base 150. Primary loop 24 of cord knot 21 is placed around primary knot support post 170. Secondary loop 26 of cord knot 21 is placed around secondary knot support post 176. Cord 20 at location of primary loop entrance cord 23 is placed in the base side cord access way 164. Cord tail 22 of cord 20 is placed in base side cord tail access way 166.

Referring again to FIG. 12, following step 204, secondary cord loop 26 is constricted and positioned flush around secondary knot support post 176 at step 206. To constrict secondary loop 26 around secondary knot support post 176, cord tail 22 is pulled by a force in direction A (see FIG. 14). With primary loop 24 not yet tightened around primary knot support post 170, space is provided between the primary knot support post 170 and primary loop 24 to allow cord to move in direction f and g (see FIG. 13). A pulling force on cord tail 22 in direction A allows for cord 20 to slide in direction f and g (see FIG. 13) so that secondary loop 26 constricts around secondary knot support post 176. A machine or person can grab cord 20 at cord tail 22 extending externally out of the base side cord tail access way 166. With cord 20 flush against secondary knot support post 176, as shown in FIG. 14, the lock component cover 120 may be attached to the lock component base 150 with less possibility of pinching and or otherwise obstructing cord 20 from moving around the secondary knot support post 176, in for example step 214.

Figure 15:
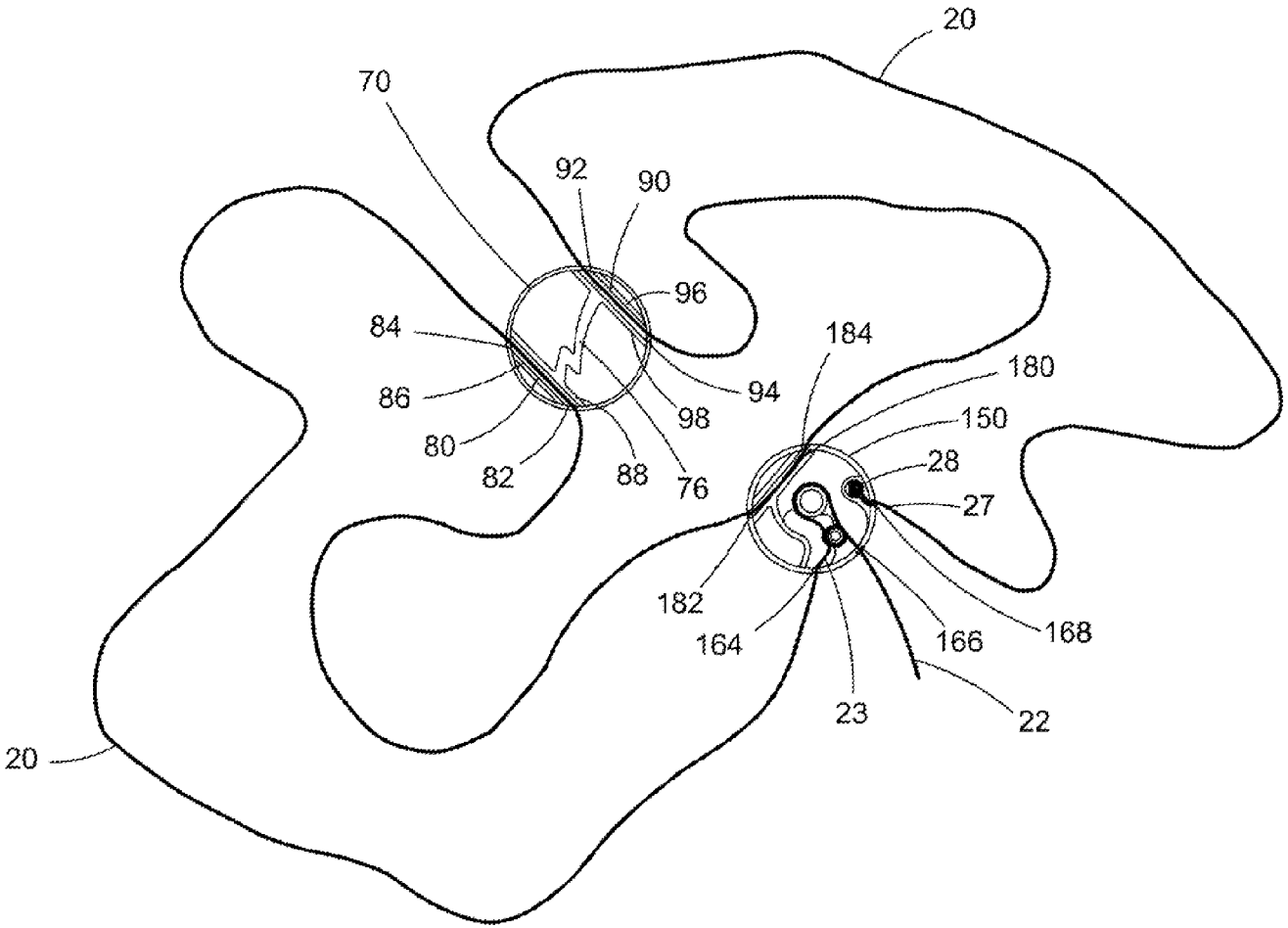
FIG. 15 illustrates cord located in the guide channels of both the crossover component base and lock component base according to one embodiment.

Referring again to FIG. 12, at step 208, portions of cord 20 are placed in guide channels of both the lock component base 150 and crossover component base 70. Cord 20, in particular cord head knot 28, may also be placed in base side depression 169 of lock component base 150 at step 208. FIG. 15 illustrates cord 20 located in the guide channels of both the crossover component base 70 and lock component base 150. A portion of cord 20 is placed first crossover cord guide channel 80, wherein cord 20 exits crossover component base 70 from channel 80 at the base side first crossover cord guide channel opening 82 and the base side second crossover cord guide channel opening 84. A portion of cord 20 is also placed in second crossover cord guide channel 90, wherein cord 20 exits crossover component base 70 from channel 90 at the base side third crossover cord guide channel opening 92 and base side fourth crossover cord guide channel opening 94. A portion of cord 20 is also placed in cord guide channel 180, wherein cord 20 exits the cord guide channel 180 of lock component base 150 at the base side first cord guide channel opening 182 and base side second cord guide channel opening 184. As shown in FIG. 15 in the preferred embodiment, a portion of cord 20, running externally from base side cord access way 164 to base side first cord guide channel opening 182, runs within the crossover component base 70, in first crossover cord guide channel 80. A portion of cord 20, running externally from base side portal 168 to base side second cord guide channel opening 184, runs within the crossover component base 70, in second crossover cord guide channel 90.

Cord 20 may slide in either direction through the guide channels of both the lock component base 150 and crossover component base 70. Cord 20 may be slid through the guide channels to either shorten or lengthen sections of cord 20, located between guide channel openings on the component base 150 and crossover component base 70.

In some embodiments, step 208 may occur anytime before, during, or after forming cord knot 21 with cord 20 in step 202. In other embodiments, step 208 may occur anytime before, during, or after positioning the cord knot 21 inside the lock component base 150 of lock component 100 in step 204. In other embodiments, step 208 may occur anytime before, during, or after condensing secondary loop 26 around secondary knot support post 176 in step 206. In other embodiments, step 208 may occur anytime before, during, or after attaching the crossover component cover 60 to the crossover component base 70 and/or attaching the lock component cover 120 to the lock, component base 150, further described in step 210.

Figure 16:
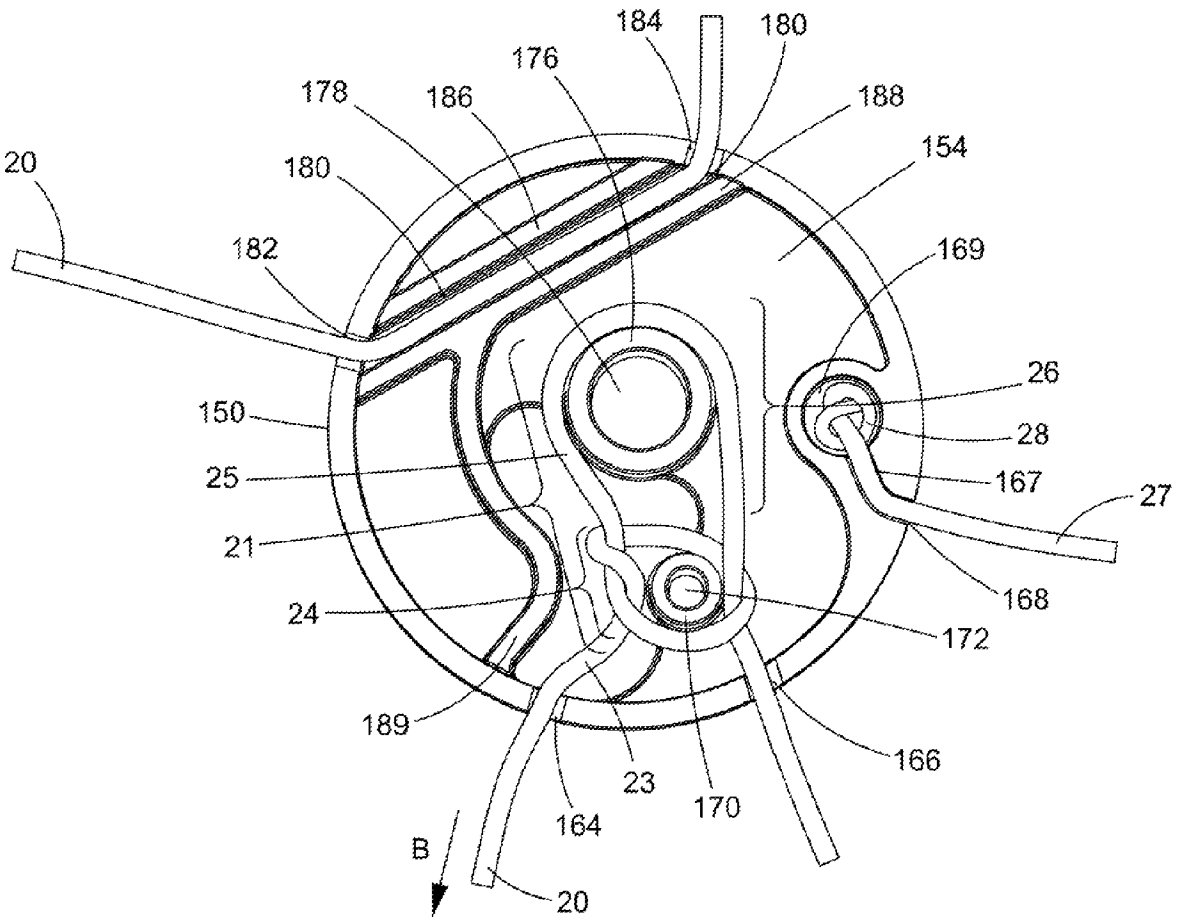
FIG. 16 illustrates cord knot as locked within the lock component according to one embodiment.

As shown in FIG. 15, and shown enlarged in FIG. 16, a cord head knot 28 is formed at the end of cord 20 about cord head 27. Cord head knot 28 is formed in size to fit at least the lower hemisphere of cord bead knot 28 within base side depression 169. Cord 20 extending at about cord head 27 from cord head knot 28 is placed in base side depression 169 with cord 20 extending therefrom placed in base side tunnel 167 and through base side portal 168. Cord head knot 28 may be placed in base side depression 169 anytime prior to step 210. The cord head knot 28 cannot be removed from the lock component 100 after the lock component cover 120 and lock component base 150 are attached. In other embodiments, if no base side depression 169, or cover side depression 128 exists, then cord 20, in proximity to cord head 27, may be attached externally to the lock component device 150 or to cord tail 22. For example, cord head 27 may be attached by adhesive to the external surface of the lock component housing 104.

Referring again to FIG. 12, at step 210 the crossover component cover 60 is aligned and fitted over the crossover component base 70 and the lock component cover 120 is aligned, and fitted over the lock component base 150. The covers may be sealed to the base along the crossover component housing seam 52 and lock device housing seam 102 respectively. In other embodiments, step 210 may occur before pulling on cord 20, in for example step 206.

Figure 17:
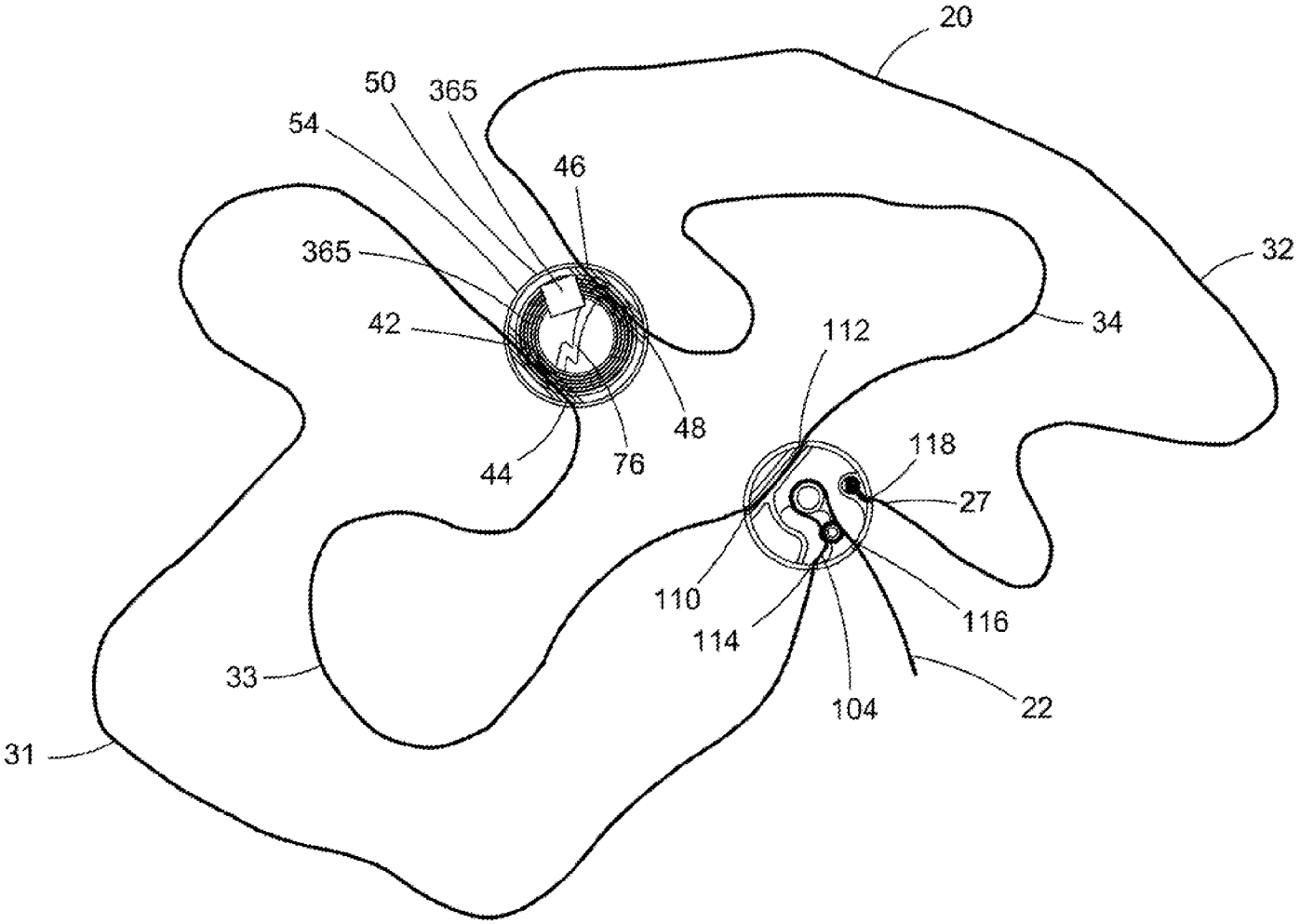
FIG. 17 illustrates the surround security device with the crossover component and the lock component connected via cord according to one embodiment.

FIG. 17 illustrates the surround security device 10 with the crossover component cover 60 connected to the crossover component base 70 forming the crossover component housing 54 and the lock component cover 120 connected to the lock component base 150 forming the lock component housing 104. Both the crossover component housing 54 and lock component housing 104 are shown as transparent so as to provide view of cord 20 positioned within, in addition, an EAS element 365 is shown in the crossover component 50, as further described in reference to FIGS. 18 and 19.

Referring again to FIG. 12, at step 212 the surround security device 10 is placed around a product. The lock component 100 and crossover component 50 are positioned on opposite sides of a product from one another. For example and referring again to FIG. 17, the crossover component 50 may be laid on a flat surface, such as a table, and then the product lay directly on top. The lock component 100 may then be positioned on the top of the product opposite the crossover component 50 on which the product is resting.

In other embodiments, external side base floor 152 or external side cover ceiling 123 of lock component housing 104 may include an adhesive substance to attach the lock component 100 to the product. In other embodiments, in alternative to or in addition to an adhesive substance on the lock component 100, the crossover external side base floor 73 or crossover external side ceiling cover 65 of crossover component housing 54 may include an adhesive substance to attach the crossover component 50 to the product. The adhesive substance may include, for example but is not limited, to glue or two-sided tape.

With either or both the lock component 100 and/or crossover component 50 secured in position about the product, with or without the addition of adhesive, cord 20 may be fit around the sides of the product. First cord section 31 shown extending from first crossover cord guide channel opening 42, located about the periphery wall of the crossover component housing 54, to the cord access way 114, about the periphery wall of the lock component housing 104, in FIG. 17, is shown around product 5 in FIG. 2. Second chord section 32, shown extending from fourth crossover cord guide channel opening 46, located about the periphery wan of the crossover component housing 54, to the portal 118, located about periphery wall of the lock, component housing 104, in FIG. 17, is shown around product 5 in FIG. 2. A third cord section 33 shown extending from second crossover cord guide channel opening 44, located about the periphery wall of the crossover component housing 54, to the first cord guide channel opening 110, about the periphery wall of the lock component housing 104, in FIG. 17, is shown around product 5 in FIG. 2. A fourth cord section 34, shown extending from third crossover cord guide channel opening 48, located about the periphery wall of the crossover component housing 54, to the second cord guide channel opening 112, about the periphery wall of the lock component housing 104, in FIG. 17, is shown around product 5 in FIG. 2.

Referring again to FIG. 12, once the lock component 100, crossover component 50, and cord 20 are positioned around the product in step 212, cord 20 may then constricted so as to be tightened around the product in step 214. To tighten cord 29 around product, cord tail 22 is pulled by a force in direction A (see FIG. 14). By pulling cord tail 22, cord 20 moves in path direction a through g, as described in FIG. 13, around the primary knot support post 170 and secondary knot support post 176 so as to constrict the length of cord 20 between cord head 27 and cord 20 at location of primary loop entrance cord 23. This in effect tightens cord 20 between the lock component 100 and crossover component 50 of the surround security device 10 around the product. Cord tail 22 may be pulled until cord 20 sufficiently secures the surround security device 10 around the product. For example, a retailer may tighten the surround security device 10 around a product so that a potential thief can not shimmy, or otherwise manipulate the product away from the surround security device 10.

Referring again to FIG. 12, at step 216, cord 20 is locked in place with cord knot 21. FIG. 16 illustrates cord 20 locked within the lock component housing 104. At step 216, cord 20 is pulled with a force at the location of the primary loop entrance cord 23, in direction B, to constrict primary loop 24 around primary knot support post 170. The pulling creates compression of primary loop 24 onto cord 20, running in direction f and g, against primary knot support post 170. After an amount of compression of primary loop 24 to bind cord tail 22 to the primary knot support post 179, cord 20 cannot slide in direction f or g if cord tail 22 is pulled in direction A. With primary loop 24 compressed around primary knot support post 170, cord 20 can no longer be pulled in either direction A or B resulting in as locked state for the surround security device 19 about the product.

Arrangement of primary knot support post 170, secondary knot support post 176, base side cord access way 164, and base side cord tail access way 166 in the lock component 100 should exist so as to allow for the positioning, and utilization of cord knot 21 within the lock component 100. As shown in FIGS. 4A and 48, base side cord access way 164 and base side cord tail access way 166 are located in proximity along the base periphery wall 154. Base side cord access way 164 and base side cord tail access way 166 may be located closer or further apart along the base periphery wall 154 so long as a force of pull on cord 20, at or near location of primary loop entrance cord 23, can tighten primary loop 24 to lock cord knot 21 and so long as a force of pull on cord tail 22 allows for cord 20 to move through primary loop 24 and secondary loop 26 to shorten cord 20 external of the lock component 100 between the base side portal 168 and base side cord access way 164. The secondary knot support 176, base side cord access way 164, and base side cord tail access way 166 may be viewed in FIGS. 4A and 4B, as each forming points of a triangle. For proper functionality of the cord knot 21, primary knot support post 170 is located in the plane or about the edges of the triangle formed between the end points of the secondary knot support 176, base side cord access way 164, and base side cord tail access way 166.

Referring to FIG. 17, cord tail 22, located external of lock device 100 from cord tail access way 116, may be cut after locking the surround security device 10 about the product in step 216. In some embodiments, a blade may be attached to either or both the base side cord tail access way 166 and/or cover side cord tail access way 126 (see FIGS. 4A and 6A). The blade edge of a blade attachment would face the opening of cord tail access way 116 where a portion of cord tail 22 resides. The blade may have a straight edge or a curved edge. For example, the curve edge may match the circumference of the half-circle shape of the notch in either the base side or cover side cord tail access way. The blade may also have as wavy edge or an angled edge, including teeth. Cord tail 22 may be cut by the blade by pulling cord tail 22 in a direction towards either the lock component base 150 or lock component cover 120, wherever the blade is attached. A pull force of cord tail 22 against the edge of the blade will cut away cord tail 22. In other embodiments, a down force on the external side base floor 152 and/or external side cover ceiling 123 in proximity to the cord access way 114 could move the blade edge against the cord tail 22 portion, located in the cord access way 114, to cut the cord tail 22. In other embodiments, the cord tail 22 may be cut by a retailer or other person. Cord tail 22 may also be left to hang or dangle from the lock component 100.

After a consumer purchases the product, the surround security device 10 may be cut away form the product and/or product packaging and removed.

In other embodiments, crossover component 50 may be considered a hard tag by including a security element within. In the electronic article surveillance WAS) industry, a "hard tag", refers to a re-usable tag which is intended to be removed from an article, e.g., merchandise at the point of sale to be re-used on other merchandise. Hard tags typically are constructed to contain an EAS element, which may be for example an acousto-magnetic element, a radio frequency element (RF), or electro-magnetic element (EM); or radio frequency identification (RFID) element, which may be respond at high and ultra high frequencies. An EAS element may include a resonant circuit with a coil coupled to a capacitor. The EAS security element is tuned to a predetermined frequency and if one attempts to removed the hard tag with the security element from a store, an alarm triggers as the tag passes through a surveillance field created by a transmitter, located between pedestals at the store exit, tuned to the same frequency. The alarm goes off as the EAS element resonates, providing an output signal detected by a receiver, also located in the pedestals. An RFID element typically includes an integrated circuit (IC) and an RF LC circuit (resonant circuit) or antenna (e.g. a dipole antenna), tuned to a predetermined RF frequency. Often, the integrated circuit IC comprises a memory that has been programmed with information associated with the article (e.g. product ID information such as a serial number, unique identification number, price, etc.). When a transmitter emits a signal at the predetermined RF frequency which is received by the tuned antenna, the RFID element emits a signal containing the stored information which is then received by a receiver and the information demodulated from the element-emitted signal. This information can then be used for, among other things, determining whether to set off an alarm or not.

As a hard tag, the crossover component 50 may be removed by a retail employee at the point of sale to be reused on other merchandise. For example, the re-used crossover component 50 as a hard tag may not include any adhesive, unlike perhaps the lock component 100 which may include adhesive to remain affixed to the product. Cord 20 may be cut at any section so as to be slipped out through the one or more cord guide channels in the crossover component 50. In other embodiments, the crossover component 50 as a hard tag may not be reused and may remain on the product for disposal by the customer. The security element may be deactivated by the retailer so as not to trip alarms after the point of sale.

Figure 18:
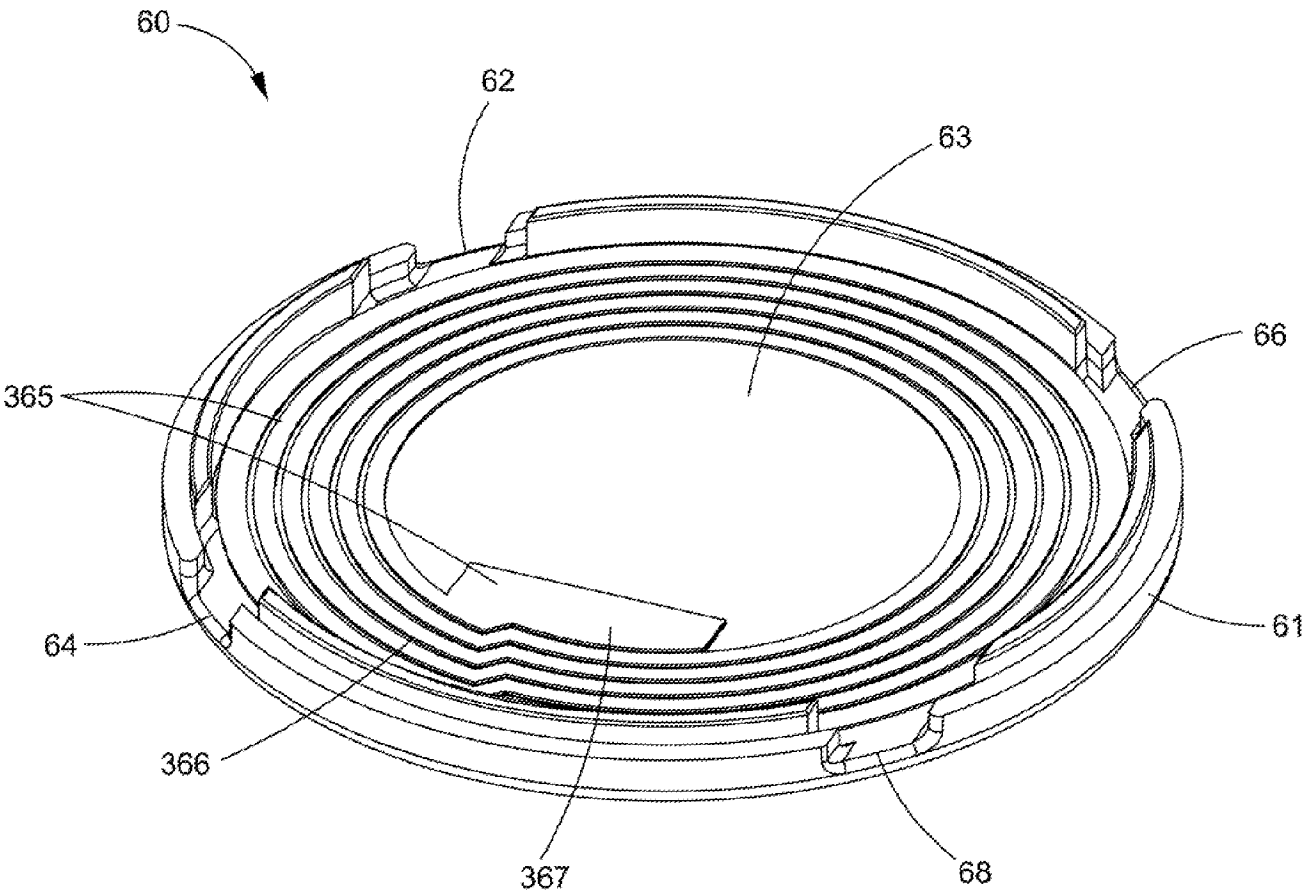
FIG. 18 illustrates an EAS element located inside crossover component cover according to one embodiment.

FIG. 18 illustrates an EAS element 365 located inside crossover component cover 60. The EAS element shown is one type of security element. Another type of security element may be an RFID element. As shown in FIG. 18, the circumference of the EAS coil 366 fits within the circumference of the crossover cover periphery 61. The connected EAS coil 366 and EAS capacitor 367, forming the EAS element 365, may be placed anytime within the crossover component cover 60 before the crossover component cover 60 is attached to the crossover component base 79. In other embodiments, adhesive may be applied to the EAS element 365 for attachment to the crossover cover internal side ceiling 63 or external side ceiling 73.

Figure 19:
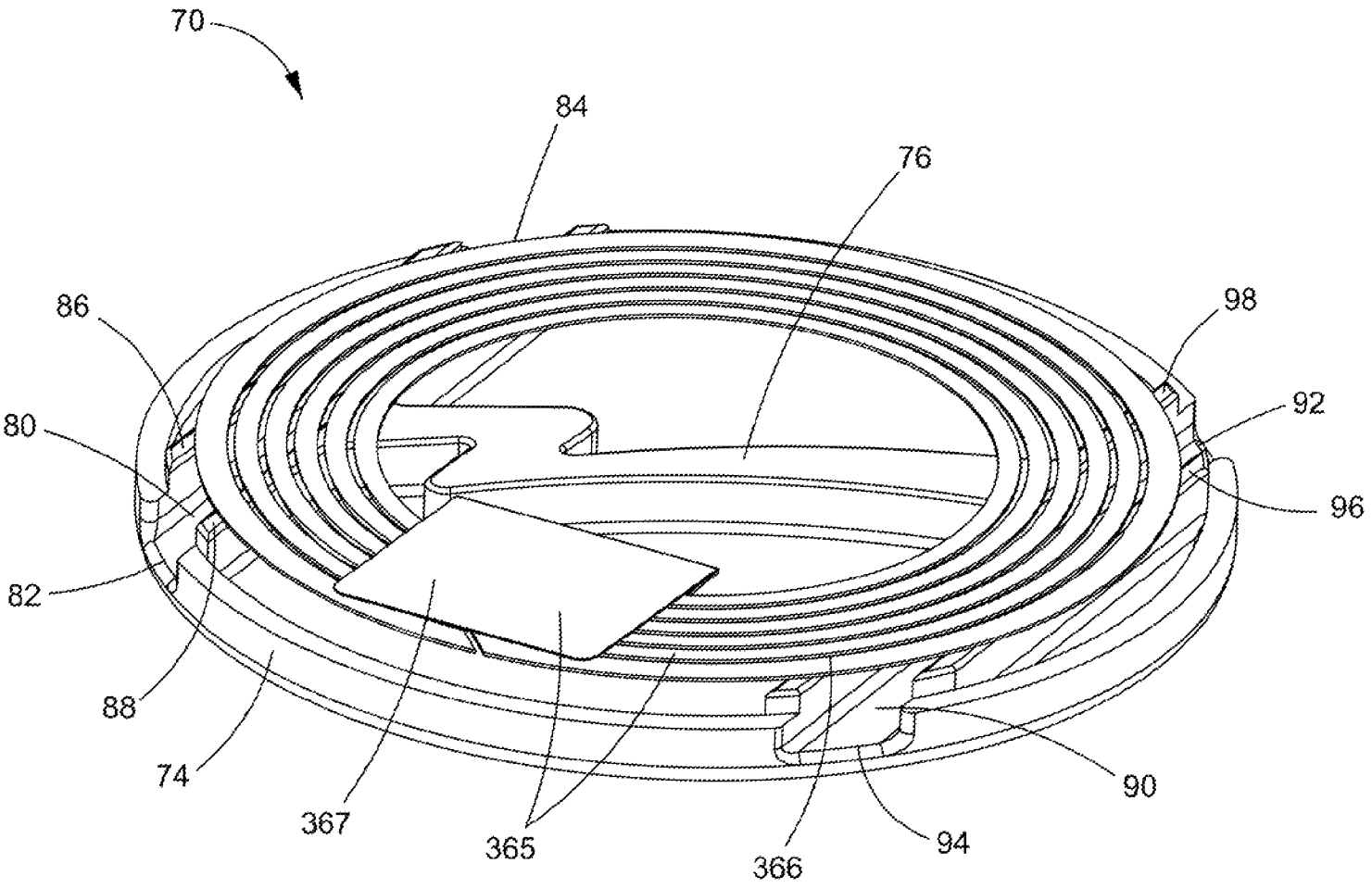
FIG. 19 illustrates an EAS element located about the crossover component base according to one embodiment.

FIG. 19 illustrates an EAS element 365 located on the crossover component base 70. As shown in FIG. 19 the EAS element 365 may be placed over and/or attached, as for example with adhesive, to the upper edge of the crossover base support wall 76, first outside guide wall 86, first inside guide wall 88, second inside guide wall 98, and second outside guide wall 96. The EAS element 365 may be attached after cord 20 is positioned within first crossover cord guide channel 80 and second cord guide channel 90.

In other embodiments, an RED element (not shown) may be placed and/or adhered to the inside of the crossover component cover 60 or crossover component base 70. In other embodiments, the EAS element 365 or RFID element may be located within the lock component housing 104 as placed either inside the lock component cover 120 or lock component base 150. In other embodiments, an EAS element 365 may be located in both the lock component housing 194 and crossover component housing 54. In other embodiments, an EAS element 365 and/or RFID element may both be located in or externally on the lock component housing 104 and/or crossover component housing 54. In other embodiments, the EAS element 365 may be located in or on the lock component housing 104 and the RFID element in or on the crossover component housing 54, or vice versa.

In other embodiments, the surround security device 10 may include the lock component 100 and cord 20, without a crossover component 50. On a product, the cord portion that would be housed in the first crossover cord guide channel 89 can be crossed with the cord portion that would be housed in the second crossover cord guide channel 90 so that the cord 20 interlocks with itself at the crossing junction. Crossing and re-crossing the cord 20 at that junction requires cord 20 to be removed from lock device housing 104. After crossed, forming cord knot 21 and placing locking knot 21 in lock device housing 104 may follow. In other embodiments, the same sections of cord 20, that would cross at the crossing junction, may be for example; twisted, bound, tied, or united in any other manner so that the surround security device may be secured around a product.

In other embodiments, one or more crossover components 50 may be used in the same surround security device 10. For example, one crossover component 50, like that shown in FIG. 15, may be aligned with a copy of the crossover component 50, so that the two crossover components may be stacked on a side of the product. With adhesive applied to both crossover components, it would take more time for a thief to pry each off, as opposed to prying just one off. In other embodiments, crossover components 50, having for example only one cord guide channel may be used at various sections of cord 20. For example, referring to FIG. 2, crossover components having only one cord guide channel may be used in addition to the crossover component 50 and lock component 100, shown in FIG. 2, on all sides of the product. The additional crossover components may be applied to the sides of the box, where the crossover component 50 and lock component 100 are not shown residing. A crossover component may be utilized with first cord section 31 running through; another crossover component may be used with second cord section 32 running through; another crossover component may be used with a third cord section 33 running through; and a fourth crossover component may be used with a fourth cord section 34 running through.

In other embodiments, surround security device 10 may utilize only the lock component 1041 and cord 20. Cord 20 may run external to the lock component 150 through only two access ways located on the periphery edge wall of the lock component 150. Cord guide channel 180 and first cord guide channel opening 110 and second cord guide channel opening 112 may not exist on the lock component 100 of the security surround, device 10. Cord 20 may run external, without running through a crossover component or other guide channels, from the cord access way 114 to portal 118. Cord tail 22 may extend from cord tail access way 116. The single cord 20 and lock component 100 may surround to portion of the product together. In this and other embodiments, lock component 100 and cord 20 may be hung from a product.

Although this disclosure has been described with reference to exemplary embodiments, it is not limited thereto. Those skilled in the art will appreciate that numerous changes and modifications may be made to the preferred embodiments and that such changes and modifications may be made without departing from the true spirit of this disclosure. It is therefore intended that the appended claims be construed to cover all such equivalent variations as fall within the true spirit and scope of this disclosure.

What is claimed is:

1. A security device for a product comprising:

a lock housing;

a first support post and a second support post positioned within the lock housing;

a cord configured to at least partially surround the product and constrict about the product, wherein the cord includes a knot having (1) a first loop configured to engage with the first support post within the lock housing to lock the cord about the product at a predefined length and (2) a second loop; and a cord tail included on an end of the cord, wherein pulling the cord tail in a direction away from the second support post results in the second loop engaging the second support post and constricting upon the second support post.

2. The security device of claim wherein the lock housing comprises:

a first outlet located about a periphery of the lock housing; and a second outlet located about a periphery of the lock housing in proximity to the first outlet.

3. The security device of claim 2, wherein the first support post is positioned approximately between the second support post, the first outlet, and the second outlet.

4. The security device of claim 3, wherein the knot adjacent cord portion is located through the first outlet and the tail end is located through the second outlet.

5. The security device of claim 4, wherein the knot further comprises:

the second loop positioned through the first loop;

wherein the cord length constricts between the head end and the knot adjacent cord portion when the tail end is pulled away externally from the second outlet of the housing to move the cord around the first support post in the first loop and around the second support post in the second loop;

wherein the first loop constricts around the second loop and the tail end at the first support post to restrict movement of the cord around the first loop and the second loop when the knot adjacent cord portion is pulled away externally from the first outlet of the housing to lock the constricted length of the cord about the product.

6. The security device of claim 4, wherein the lock housing comprises a blade, attached in proximity to the second outlet, to cut away the tail end of the cord.

7. The security device of claim 2, wherein the lock housing comprises:

a lock housing guide channel positioned inside the lock housing; and a pair of lock housing openings, wherein each lock housing opening of the pair of lock housing openings is located about the periphery of the lock housing;

wherein the lock housing guide channel runs between each lock housing opening;

wherein a section of the cord, between the knot adjacent cord portion and head end, is positioned in the lock housing guide channel and through the pair of lock housing openings.

8. The security device of claim 1, further comprising one or more crossover housings comprising:

at least one guide channel positioned inside the crossover housing; and at least one pair of crossover openings, wherein each crossover opening of the pair of crossover openings is located about the periphery of the crossover housing;

wherein the crossover guide channel runs between each crossover opening; and wherein a section of the cord, external of the lock housing, is positioned in the crossover guide channel and through the pair of crossover openings.

9. The security device of claim 8, wherein at least one side of the crossover housing comprises an adhesive to fasten the crossover housing to the product.

10. The security device of claim 8, wherein the crossover housing further comprises at least one crossover housing support wall, positioned within the crossover housing, to counter an external force on the crossover housing.

11. The security device of claim 8, wherein the crossover housing further comprises a security element positioned within the crossover housing and wherein the security element is selected from at least one of an EAS element or an RFID element.

12. The security device of claim 11, wherein the lock housing further comprises a security element positioned within the lock housing and wherein the security element is selected from at least one of an EAS element or an RFID element.

13. The security device of claim 1, wherein at least one side of the lock housing comprises an adhesive to fasten the lock housing to the product.

14. The security device of claim 1, wherein the lock housing further comprises at least one lock housing support wall, positioned within the lock housing, to counter external force on the lock housing.

15. The security device of claim 1, wherein material of the cord is selected from at least one of metal, plastic, cloth, rubber, wool, or silk.

16. The security device of claim 1, wherein the lock housing further comprises a security element positioned within the lock housing and wherein the security element is selected from at least one of an EAS element or an RFID element.

17. A method for securing a product comprising:

positioning a first support post within a lock housing;

surrounding a portion of the product with a cord, wherein the cord includes a knot and the knot includes a first loop;

engaging the first loop of the knot with the first support post within the lock housing;

pulling a tail end of the cord away externally from a second outlet of the lock housing and from the knot to constrict the length of the cord between a head end of the cord and a knot adjacent cord portion of the cord, located through a first outlet, wherein the first outlet and second outlet are located about a periphery of the lock housing, the head end is positioned in the housing, and the knot adjacent cord portion is located approximate to the knot on the opposite side of the knot from the tail end;

pulling the knot adjacent cord portion away externally from the first outlet to constrict a first loop of the knot around a second loop of the knot and the tail end at a first support post in the lock housing, wherein the lock housing comprises (1) a base having the first support post and a second support post positioned within, and (2) a cover, the first support post being positioned approximately between the second support post, the first outlet, and the second outlet;

locking the cord in place around the product at a predefined length; and surrounding at least a portion of the product with part of the cord.

18. The method of claim 17, further comprising:

forming the knot in the cord; and positioning the knot into the base of the lock housing prior to tightening to constrict the length of the cord.

19. The method of claim 18, wherein forming the knot comprises:

forming the first loop in the knot with the tail end of the cord and the cord;

forming the second loop in the knot with the tail end between the tail end and the first loop; and passing the tail end about the second loop through the formed first loop.

20. The method of claim 19, wherein positioning the knot into the base of the lock housing comprises:

positioning the formed first loop around the first support post in the base;

positioning the formed second loop around the second support post in the base;

positioning the knot adjacent cord portion of the cord into the first outlet; and positioning the tail end of the cord into the second outlet.

21. The method of claim 20 further comprising placing the head end of the cord into the base portion.

22. The method of claim 20 further comprising attaching the cover to the base prior to surrounding the portion of the product.

23. The method of claim 22 further comprising positioning a security element into the lock housing prior to attaching the cover to the base, wherein the security element is selected from at least one of an EAS element or an RFID element.

24. The method of claim 22, further comprising welding the attached cover to the base about a seam about a periphery of the lock housing.

25. The method of claim 17, further comprising:

positioning a section of the cord, external of the lock housing, in one or more crossover guide channels and through one or more pair of crossover openings, wherein the one or more crossover guide channels are located inside one or more crossover bases and the one or more pair of crossover openings are located about the periphery of the crossover base, and wherein the crossover guide channel runs between each crossover opening in the pair of crossover openings;

attaching a crossover cover to the crossover base to form a crossover housing to enclose the section of cord.

26. The method of claim 25, further comprising fastening the one or more crossover housings to the product with adhesive.

27. The method of claim 25, further comprising positioning a security element into the crossover housing prior to attaching the crossover cover to the crossover base, wherein the security element is selected from at least one of an EAS element or an RFID element.

28. The method of claim 17, further comprising fastening the lock housing to the product with adhesive.

29. The method of claim 17, further comprising:

positioning a section of the cord, between the knot adjacent cord portion and the head end, into a lock housing guide channel and through a pair of lock housing openings prior to tightening the cord around the product, wherein the lock housing guide channel is located inside the base and the lock housing openings are located about the periphery of the base, and wherein the lock housing guide channel runs between each lock housing opening in the pair of lock housing openings.

30. The method of claim 17, further comprising cutting the tail end of the cord by a blade attached in proximity to the second outlet of the lock housing after tightening the cord around the product.

31. The method of claim 30, wherein cutting the tail end of the cord comprises forcing the cover down onto the base about the second outlet to move the blade through the cord.

* * * * *

UNITED STATES PATENT AND TRADEMARK OFFICE

CERTIFICATE OF CORRECTION

PATENT NO. : 8,938,997 B2
APPLICATION NO. : 13/732701
DATED : January 27, 2015
INVENTOR(S) : Anthony F. Piccoli et al.

It is certified that error appears in the above-identified patent and that said Letters Patent is hereby corrected as shown below:

In the Specification

Column 1
Line 31, please delete "lock" and insert in place thereof --locks--.

Column 2
Line 40, please delete "in" and insert in place thereof --fit--.
Line 40, please delete "not" and insert in place thereof --knot--.

Column 3
Line 5, please delete "mop" and insert in place thereof --loop--.
Line 41, please delete "ho sing" and insert in place thereof --housing--.
Line 45, please delete "three" and insert in place thereof --force--.
Line 65, please delete "REID" and insert in place thereof --RFID--.

Column 4
Line 21, please delete "haying" and insert in place thereof --having--.
Line 45, please delete "bead" and insert --head--.

Column 5
Line 9, please delete "to" and insert in place thereof --a--.

Column 7
Line 47, please delete "howling" and insert in place thereof --bowling--.

Column 8
Line 45, please delete "thrilled" and insert in place thereof --formed--.

Signed and Sealed this
Thirtieth Day of June, 2015

Michelle K. Lee

Michelle K. Lee
*Director of the United States Patent and Trademark Office*

Column 9
Line 33, please delete “far” and insert in place thereof --for--.
Line 55, please delete “not” and insert in place thereof --knot--.
Line 60, please delete “ID” and insert in place thereof --in--.

Column 10
Line 41, please delete “with” and insert in place thereof --width--.

Column 12
Line 10, please delete “airfare” and insert in place thereof --surface--.
Line 59, please delete “ardor” and insert in place thereof --and/or--.
Line 63, please delete “to” and insert in place thereof --a--.

Column 13
Line 57, please delete “has” and insert in place thereof --base--.

Column 18
Line 22, please delete “conned” and insert in place thereof --formed--.
Line 34, please delete “him” and insert in place thereof --film--.
Line 40, please delete “tad” and insert in place thereof --tail--.

Column 20
Line 18, please delete “bead” and insert in place thereof --head--.

Column 21
Line 60, please delete “as” and insert in place thereof --a--.

Column 22
Line 30, please delete “as” and insert in place thereof --a--.
Line 49, please delete “WAS” and insert in place thereof --EAS--.

Column 23
Line 34, please delete “79” and insert in place thereof --70--.
Line 47, please delete “RED” and insert in place thereof --RFID--.
Line 54, please delete “194” and insert in place thereof --104--.
Line 65, please delete “89” and insert in place thereof --80--.

Column 24
Line 34, please delete “1041” and insert in place thereof --100--.

In the Claims

Column 25
Line 6, please insert --1-- following “claim”.
Line 15, please delete “3” and insert --2-- following “claim”.